US009057580B2

(12) United States Patent
Rorick et al.

(10) Patent No.: US 9,057,580 B2
(45) Date of Patent: Jun. 16, 2015

(54) QUICK DRAW GUN HOLSTER WITH INTERACTIVE ACCESSORY DEVICE

(71) Applicant: SureFire, LLC, Fountain Valley, CA (US)

(72) Inventors: Steven Rorick, Riverside, CA (US); John W. Matthews, Newport Beach, CA (US)

(73) Assignee: SureFire, LLC, Fountain Valley, CA (US)

( * ) Notice: Subject to any disclaimer, the term of this patent is extended or adjusted under 35 U.S.C. 154(b) by 0 days.

(21) Appl. No.: 13/890,570

(22) Filed: May 9, 2013

(65) Prior Publication Data

US 2013/0301243 A1 Nov. 14, 2013

Related U.S. Application Data

(63) Continuation-in-part of application No. 13/662,352, filed on Oct. 26, 2012, which is a continuation-in-part of application No. 13/470,063, filed on May 11, 2012.

(60) Provisional application No. 61/800,750, filed on Mar. 15, 2013.

(51) Int. Cl.
*F41C 33/02* (2006.01)
*F41G 1/00* (2006.01)

(52) U.S. Cl.
CPC ..... *F41C 33/0254* (2013.01); *F41G 1/00* (2013.01); *F41C 33/0263* (2013.01)

(58) Field of Classification Search
CPC .. F41C 33/02; F41C 33/0236; F41C 33/0245; F41C 33/0254; F41G 1/35
USPC ..... 224/243, 244, 238, 191–198, 912; D2/222; 362/110–114; 42/146, 114, 42/123, 132
See application file for complete search history.

(56) References Cited

U.S. PATENT DOCUMENTS

| | | | | |
|---|---|---|---|---|
| 2,336,718 | A | 12/1943 | Davis | |
| 3,550,822 | A | 12/1970 | Lloyd | |
| 4,713,889 | A * | 12/1987 | Santiago | 42/132 |
| 4,912,867 | A | 4/1990 | Dukes, Jr. | |
| 6,112,962 | A | 9/2000 | Matthews | |
| 6,267,279 | B1 * | 7/2001 | Matthews | 224/243 |
| 7,395,627 | B2 | 7/2008 | La France et al. | |
| 8,215,525 | B2 | 7/2012 | Rassias | |
| 8,602,276 | B2 | 12/2013 | Tyybakinoja | |
| 2005/0024807 | A1 | 2/2005 | Cerovic et al. | |
| 2005/0224537 | A1 | 10/2005 | Rassias | |
| 2006/0026886 | A1 * | 2/2006 | Doukas | 42/117 |

(Continued)

FOREIGN PATENT DOCUMENTS

| | | |
|---|---|---|
| DE | 10 2007 049 954 | 4/2009 |
| FR | 2 659 430 | 9/1991 |

(Continued)

*Primary Examiner* — Justin Larson
*Assistant Examiner* — Phillip Schmidt
(74) *Attorney, Agent, or Firm* — Haynes and Boone, LLP

(57) ABSTRACT

In accordance with the present disclosure, novel quick draw hand gun holsters are described, together with methods for using them, that are capable, at a user's option, of activating a light accessory, such a light and/or laser sighting device, when the gun is drawn from the holster, and of deactivating it when the gun is inserted in the holster. Additional embodiments are also described.

26 Claims, 31 Drawing Sheets

(56) References Cited

U.S. PATENT DOCUMENTS

| | | | |
|---|---|---|---|
| 2006/0157520 | A1 | 7/2006 | Clifton, Jr. |
| 2006/0226185 | A1 | 10/2006 | Har-Shen |
| 2008/0110947 | A1 | 5/2008 | Pikielny |
| 2008/0121670 | A1 | 5/2008 | Buress |
| 2011/0011904 | A1 | 1/2011 | Schultz et al. |
| 2012/0097718 | A1 | 4/2012 | Baumann et al. |

FOREIGN PATENT DOCUMENTS

| | | |
|---|---|---|
| WO | WO 95/13515 | 5/1995 |
| WO | WO 98/40686 | 9/1998 |
| WO | WO 2009/064326 | 5/2009 |

* cited by examiner

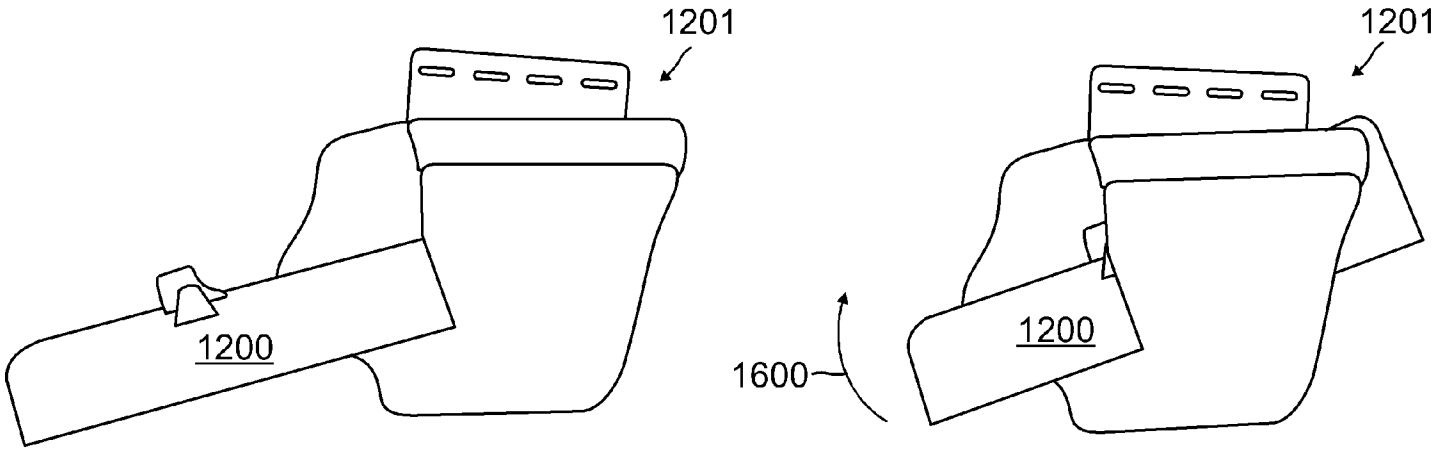
FIG. 16a
FIG. 16b
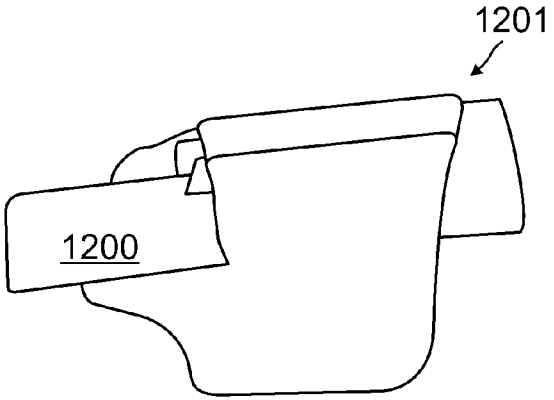
FIG. 16c

QUICK DRAW GUN HOLSTER WITH INTERACTIVE ACCESSORY DEVICE

CROSS-REFERENCE TO RELATED APPLICATIONS

This application claims the benefit of U.S. Provisional Patent Application No. 61/800,750 filed Mar. 15, 2013 which is hereby incorporated by reference in its entirety.

This application is a continuation-in-part of U.S. patent application Ser. No. 13/662,352 filed Oct. 26, 2012, which is a continuation-in-part of U.S. patent application Ser. No. 13/470,063 filed May 11, 2012, all of which are hereby incorporated by reference in their entirety.

BACKGROUND

1. Technical Field

This disclosure relates to firearms in general, and in particular, to embodiments of a quick draw holster for a handgun incorporating an accessory that can, at the user's option, activate the accessory when the gun is drawn from the holster, and deactivate it when the gun is inserted in the holster.

2. Related Art

Holsters for carrying a handgun on the person of a wearer are widely known in the field of firearms and have been in use for many years. Some holsters rely on friction to secure the handgun in the holster, but this arrangement might not be suitable during certain movements of the wearer that could cause the frictional grip of the holster on the gun to be broken.

Other holsters rely on an "over-center" design that incorporates one or more springs to secure the gun. This type of holster has the drawback that certain accelerations applied to the holster can act to compress the spring(s) and cause an unexpected release of the gun from the holster at a critical moment.

Additional holster designs have incorporated straps, flaps, hood enclosures, and the like, to secure the gun therein. However, unfastening these enclosures before drawing the gun can take an unacceptable amount of time in exigent circumstances, e.g., combat.

Also, in some instances, the handgun can be equipped with an accessory, such as a silencer, a light accessory, in which case, the holster must be capable of accommodating the accessory, yet still enable the gun to be removed from the holster with a quick and short draw, preferably with a length that is shorter than the overall length of the gun and accessory combination. Further, it would be advantageous if the holster is capable, at the user's option, of activating a light accessory when the gun is drawn from in the holster, and of deactivating it when gun is inserted in the holster.

A need therefore exists for a quick draw handgun holster that is capable, at the user's option, of activating a light accessory when the gun is drawn from the holster and of deactivating it when the gun is inserted in the holster.

SUMMARY

In accordance with the present disclosure, novel quick draw hand gun holsters are described, together with methods for using them, that are capable, at a user's option, of activating an accessory device when the gun is drawn from the holster, and of deactivating it when the gun is inserted in the holster. Such an accessory device may be, for example, a lighting device (e.g., a light and/or laser sighting device) and/or other type of accessory device as desired.

In accordance various embodiments of the present disclosure, novel quick draw hand gun holsters are described, together with methods for using them, that enable the guns to mount accessories, such as silencers, lights and/or lasers, and to be carried securely on the person of a user during strenuous physical activities, yet which enable them to be drawn for use quickly, safely and reliably.

In accordance with an embodiment, a holster is provided that includes: a housing adapted to receive a handgun assembly comprising a handgun and an accessory device attached to the handgun; and a structure protruding from the housing and adapted to: move a switch of the accessory device to an off position as the handgun assembly is inserted into the holster, and hold the switch in the off position while the handgun assembly is retained in the holster.

In accordance with another embodiment, a method is provided that includes: inserting a handgun assembly into a housing of a holster, wherein the handgun assembly comprises a handgun and an accessory device attached to the handgun; moving a switch of the accessory device to an off position in response to the inserting, wherein the moving is performed by a structure protruding from the housing; and holding the switch in the off position while the handgun assembly is retained in the holster, wherein the holding is performed by the structure.

In accordance with another embodiment, a holster is provided that includes: an adapter having an internal cavity defined by a pair of generally parallel side walls held in spaced opposition to each other by a top wall, the internal cavity being configured to receive a handgun component; a plurality of fixed projecting features on an inner surface of the side walls and projecting into the internal cavity, each fixed projecting feature adapted to be received by corresponding receiving features on the handgun component; a movable projecting feature on an inner surface of the side walls, the movable projecting feature being resiliently biased to project into the internal cavity, the movable projecting feature adapted to be engaged by a latching feature on the handgun component; and a mechanism for actuating the movable projecting feature against its resilient bias so as to withdraw the movable projecting feature from engagement with the latching feature.

In accordance with another embodiment, a handgun component adapted to be received by a holster is provided that includes: an elongated body having a distal end and opposing sides; a first pair of slots adjacent the distal end on the opposing sides, each slot in the first pair being configured to receive a corresponding pin from the holster; and a second pair of slots proximally located with regard to the first pair of slots on the opposing sides, each slot in the second pair being configured to receive a corresponding pin from the holster; and a latching recess on one of the opposing sides, the latching recess being configured to receive a locking pin from the gun holster.

In accordance with another embodiment, a method of engaging a handgun component into a holster is provided that includes: while first projecting features in the holster engage first guide walls on the handgun component, inserting the handgun component into the holster until the first projecting features engage stops on the handgun component; and while the first projecting features engage the stops, rotating the handgun component about the stops so that second projecting features in the holster engage second guide walls on the handgun component.

In accordance with another embodiment, a gun holster comprises a generally U-shaped adapter configured to be coupled to a lower surface of a front end portion of the gun's receiver. The adapter has opposing side walls, each having one of a pair of forwardly extending longitudinal lands disposed thereon, each land having a notch disposed in a lateral edge thereof. The holster further includes a generally Π -shaped housing having a pair of side walls held in spaced opposition by a spacer wall coupled between corresponding edges thereof. Each side wall has an interior surface containing one of a pair of forwardly extending longitudinal grooves disposed therein, each groove being configured to receive a corresponding one of the lands of the adapter in a slide-in engagement. A latching mechanism is configured to engage at least one of the notches in the lands of the adapter so as to prevent the withdrawal of the adapter from the housing until it is selectably released therefrom. In addition, a release mechanism is configured to selectably release the engagement of the latching mechanism with the at least one notch so as to enable the withdrawal of the adapter from the housing.

In accordance with another embodiment, a method for using the holster comprises coupling the adapter to the gun, and inserting the gun and adapter into the housing such that the lands of the adapter are slideably received in corresponding ones of the longitudinal grooves of the housing, and the latching mechanism is engaged with the at least one notch.

The scope of this invention is defined by the claims appended hereafter, which are incorporated into this section by reference. A more complete understanding of embodiments of the present invention will be afforded to those skilled in the art, as well as a realization of additional advantages thereof, by a consideration of the following detailed description of one or more example embodiments, especially if such consideration made with reference to the appended sheets of drawings, described briefly below, and within which like reference numerals are used to identify like elements illustrated in one or more of the figures thereof.

BRIEF DESCRIPTION OF THE DRAWINGS

FIG. 16*a* is a perspective view of a user initially inserting the gun slide of FIG. 12 into the holster;

FIG. 16*b* is a perspective view of a user having fully distally inserted the gun slide of FIG. 16*a* prior to engaging the latch recess;

FIG. 16*c* is a perspective view of a user having completely engaged the gun slide of FIG. 16*b* into the holster such that the latch recess engages the locking pin.

DETAILED DESCRIPTION

Figure 1B:
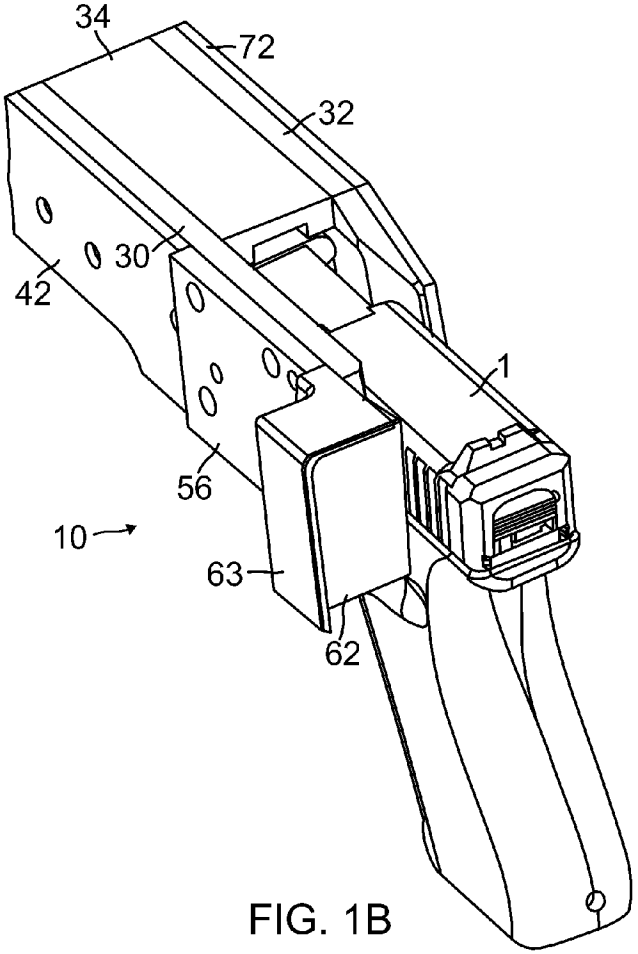
FIG. 1B is an upper, left side, rear perspective view of the holster and gun of FIG. 1A.
Figure 1A:
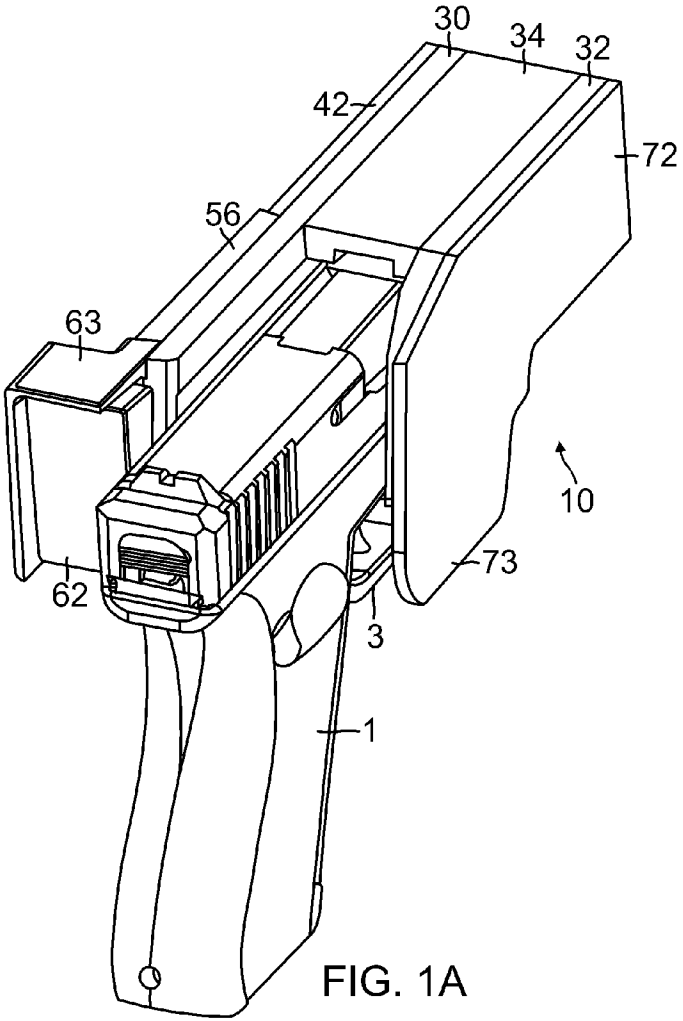
FIG. 1A is an upper, right side, rear perspective view of a quick draw holster and associated handgun in accordance with a first embodiment.
Figure 1C:
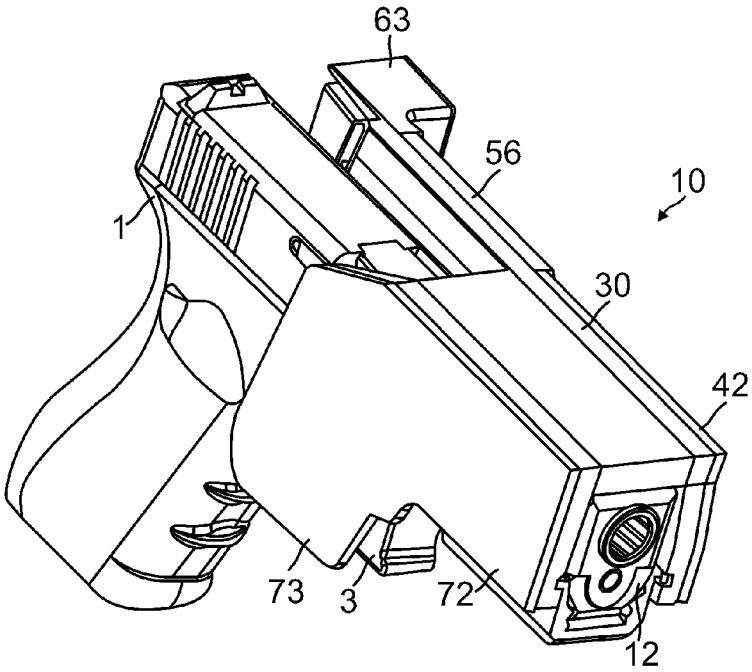
FIG. 1C is an upper, left side, front perspective view of the holster and gun of FIG. 1A.
Figure 1D:
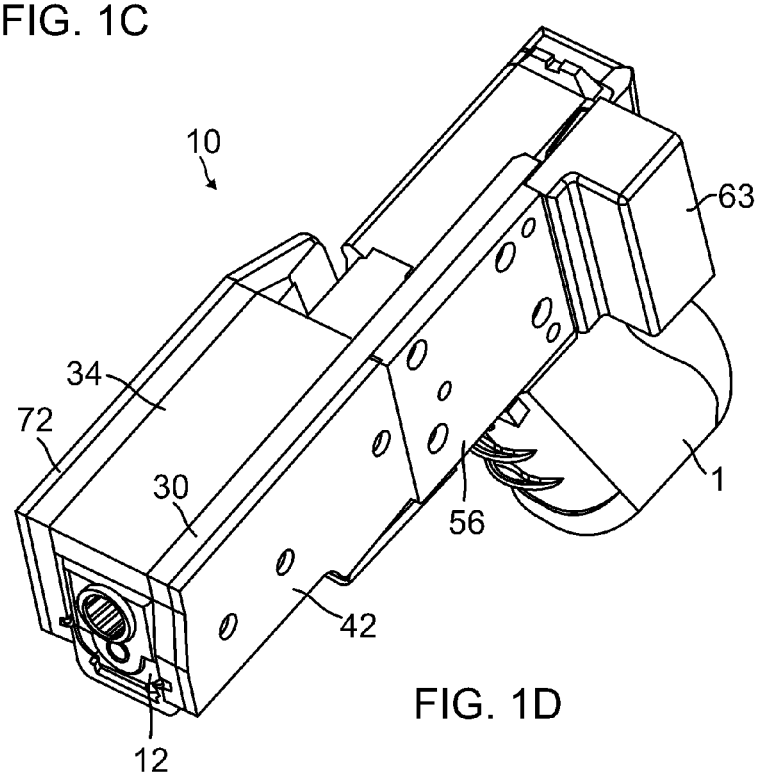
FIG. 1D is an upper, right side, front perspective view of the holster and gun of FIG. 1A.
Figure 2A:
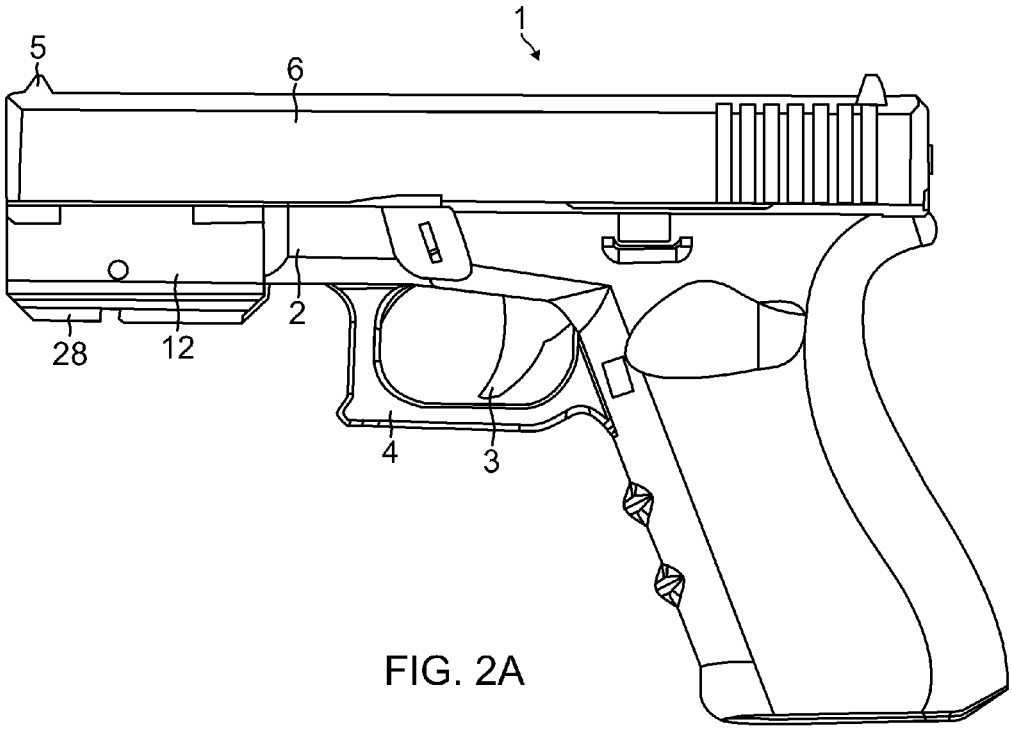
FIG. 2A is a left side elevation of an example embodiment of a holster adapter in accordance with the first embodiment, shown coupled to an associated handgun.
Figure 2B:
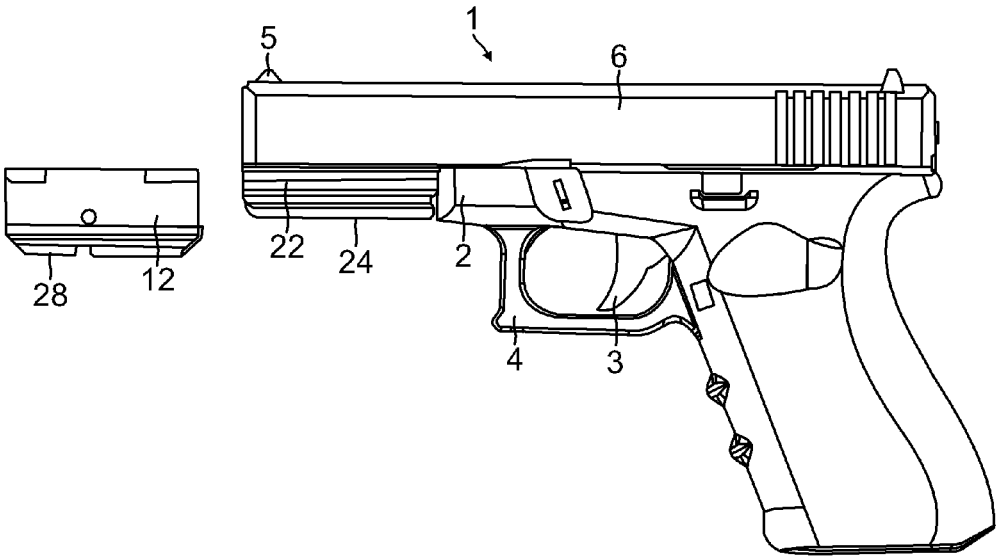
FIG. 2B is an exploded left side elevation view of the holster and adapter of FIG. 2A.
Figure 3A:
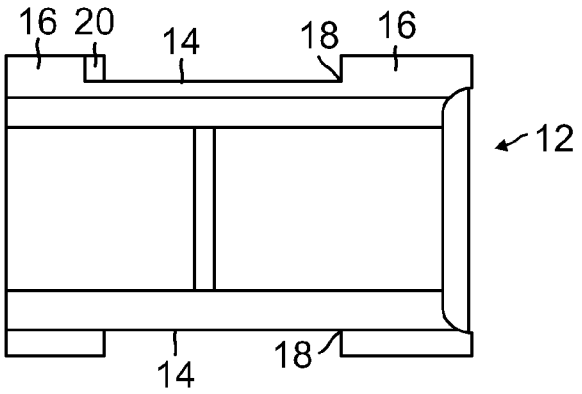
FIGS. 3A-3E are top plan, front end elevation, left side elevation, rear end elevation, and bottom plan views, respectively, of the example holster adapter of FIGS. 2A and 2B.
Figure 3B:
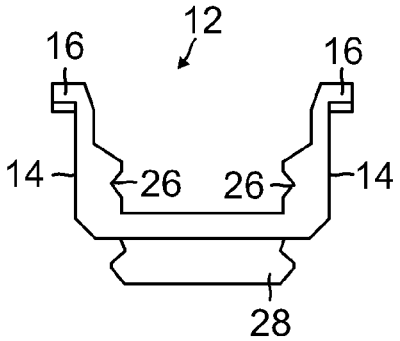
Figure 3C:
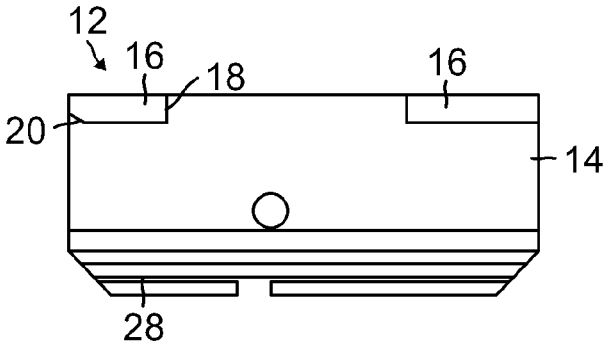
Figure 3D:
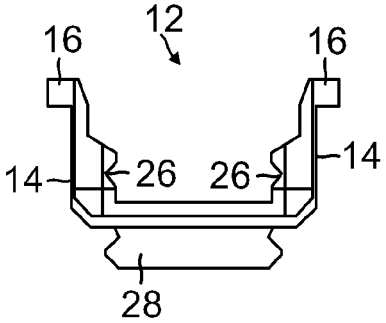
Figure 3E:
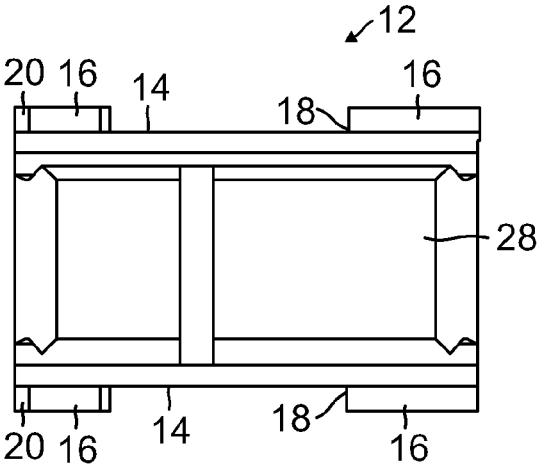

In accordance with the present invention, holsters for hand guns are provided that enable guns to be carried securely on the person of a wearer, yet which also enable the gun and accessories to be drawn from the holster for use in a quick, safe and reliable manner. The secure holstering of the gun and its quick release from the holster also accommodate accessories mounted on the gun, such as silencers, flashlights and/or laser targeting devices. In one example embodiment, a holster is capable, at the user's option, of activating a light accessory when the gun is drawn from in the holster, and of deactivating it when gun is inserted in the holster.

The holsters may be chest mounted, more preferably in a concealed fashion, but can also be carried on a high or a low belt rig. The holsters of the present invention can be used on a wide variety of hand held guns, although their internal mechanisms remain substantially similar. To accommodate different handguns, the shape and size of the constituent parts can be easily varied during their manufacture. As an alternative to using discrete "billet" parts, the holster housing may be manufactured using a molding process.

The holsters engage a hand gun component using complementary features. One element (either the hand gun component or the holster) includes a projecting feature such as one or more lands or pins, whereas, the remaining elements include a receiving feature, such as one or more grooves or recesses to receive the projecting feature(s). There are thus two main embodiments used for such engagement: 1) a first embodiment that has the projecting elements on the hand gun component and the receiving elements in the holster; and 2) a second embodiment that has the projecting elements on the holster and the receiving elements in the hand gun component. The first embodiment will be discussed initially followed by a discussion of the second embodiment. In addition, a third embodiment will also be described which may be used, for example, to control operation of an accessory device, such as a lighting device, attached to a gun. Any of the features and embodiments described herein may be combined as desired to provide various holster implementations.

First Example Embodiment

A quick draw holster 10 in accordance with the first embodiment is illustrated in the perspective views of FIGS. 1A-1D, where it is shown carrying an associated handgun 1. In the particular embodiment illustrated, the associated gun 1 comprises, as an example, a Glock semiautomatic pistol. However, as will become clear in the following description, the holster 10 can easily be modified to accommodate a wide variety of other types of pistols, such as the Colt M1911 pistol, the H&K P7 and USP pistols, the Steyr M series pistols, the Smith & Wesson MP series pistols, and many others, as well.

As illustrated in, e.g., FIGS. 2A, 2B and 3A-3E, the holsters 10 of the present invention utilize a holster adapter 12 that serves as an interface between the holster 10 and the associated gun 1. Thus, no direct contact occurs between the holster 10 and the associated gun 1. Rather, the holster 10 holds, retains and ejects the gun 1 through the agency of the adaptor 12. As may be seen in FIGS. 2A, 2B and 3A-3E, the example adapter 12 illustrated, which is configured to couple the holster 10 to the Glock pistol discussed above, incorporates a generally U-shaped cross-section configured to be coupled to a lower surface of a front end portion of the gun's receiver 2. The adapter 12 has opposite side walls 14, each of which has one of a pair of forwardly extending longitudinal lands 16 disposed thereon. Each land 16 incorporates a notch 18 disposed in a lateral edge thereof that can be used as discussed below to retain the adapter 12, and hence the gun 1, in the holster 10. In some embodiments, the front and rear ends of the longitudinal lands 16 can incorporate ramp features 20 that can facilitate interaction with the retaining and/or ejector mechanisms described in more detail below.

As those of some skill in the art will appreciate, some handguns 1, such as the example Glock illustrated in the figures above, incorporate a pair of longitudinal grooves 22 (see FIG. 2B) on the lower surface of a front end portion of the gun's receiver 2 that defines a mounting rail 24 for mounting an accessory, such as lights or a laser sighting devices of a known type. As illustrated in the cross-sectional views of the adapter 12 in FIGS. 3B and 3D, the adapter 12 can utilize these features for coupling the adapter 12 to the gun 1 by incorporating complementary rail-receiving grooves 26 on the interior walls of the adapter 12, then reproduce the accessory mounting rail 24 of the gun 1 with a similar mounting rail 28 disposed on the lower surface of the adapter 12. In this manner, the functionality of the accessory mounting rail 24 on the gun 1 is preserved.

Figure 9:
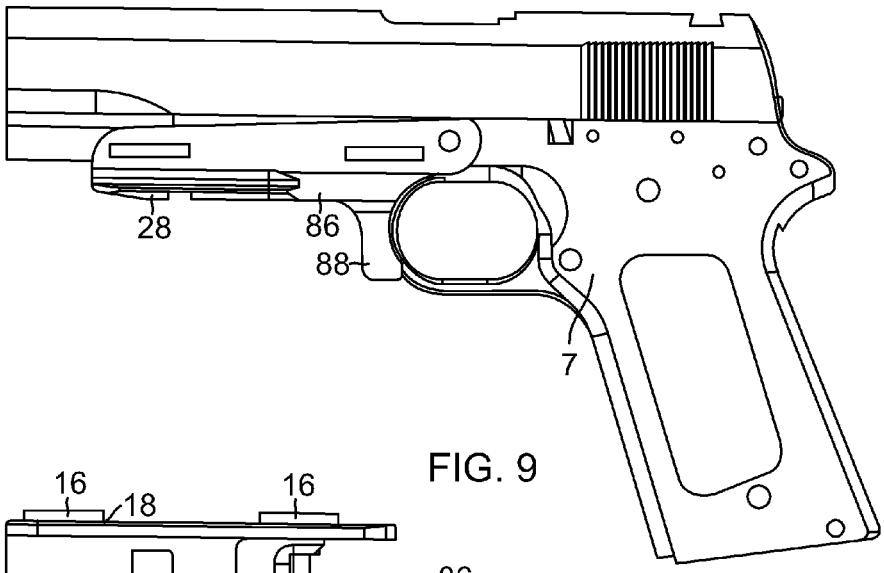
FIG. 9 is a left side elevation view of an alternative embodiment of a holster adapter in accordance with the present invention, shown coupled to another handgun.
Figure 10A:
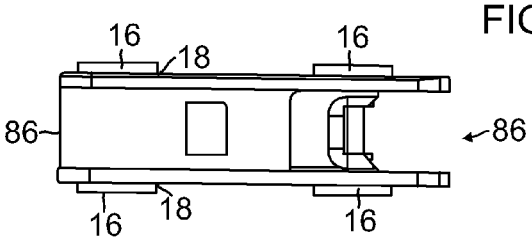
FIGS. 10A-10E are top plan, front end elevation, left side elevation, rear end elevation, and bottom plan views, respectively, of the alternative holster adapter of FIG. 9.
Figure 10B:
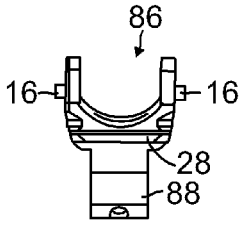
Figure 10C:
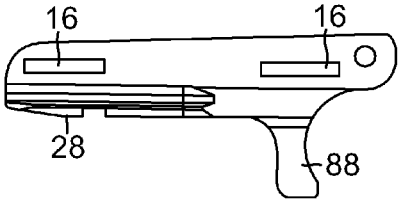
Figure 10D:
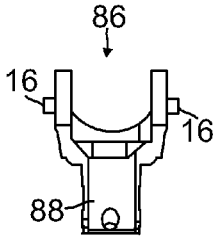
Figure 10E:
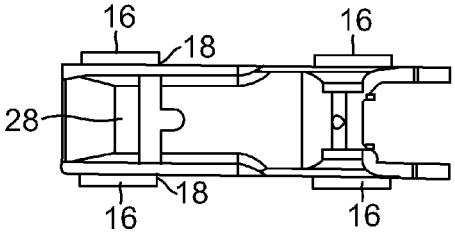

Indeed, as discussed below in connection with the alternative adapter 86 and gun 7 embodiment of FIG. 9, the holster adapters of the present invention can be used to provide an accessory mounting feature, such the mounting rail 28, on guns 7 of a type that do not ordinarily include an accessory mounting feature. Thus, in some embodiments, the holster adapter 12 can serve two purposes, viz., adapting the gun 1 to the holster 10, and providing the gun 1 with an accessory mounting feature.

Figure 4A:
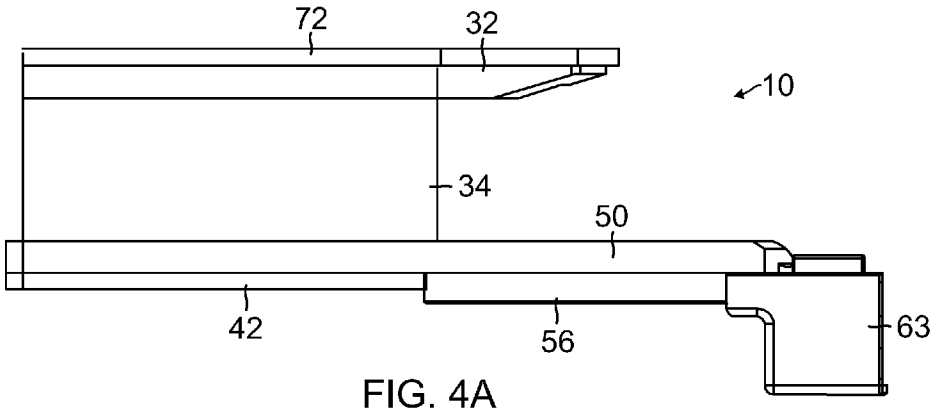
FIGS. 4A-4F are top plan, left side elevation, rear end elevation, right side elevation, bottom plan, and front end elevation views, respectively, of the holster of FIG. 1A.
Figure 4B:
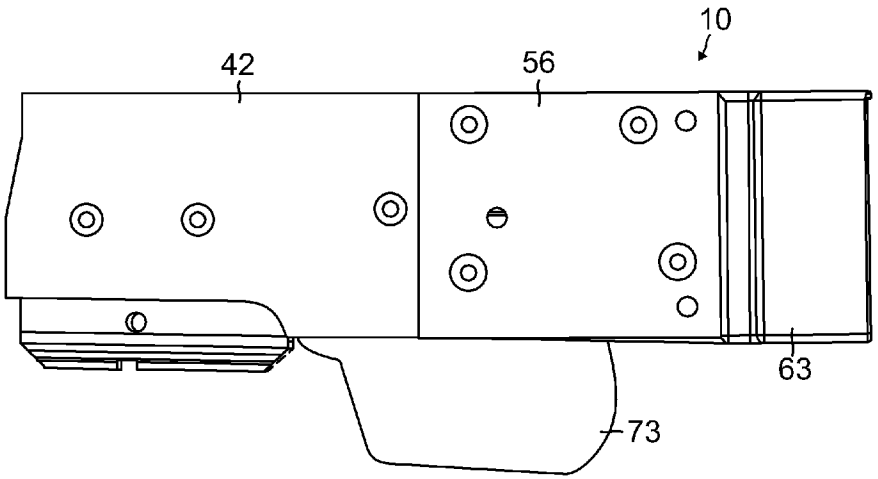
Figure 4C:
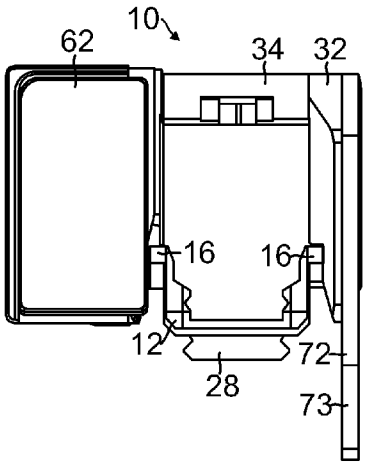
Figure 4F:
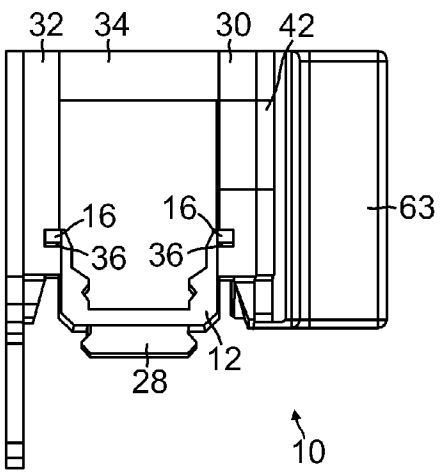
Figure 4D:
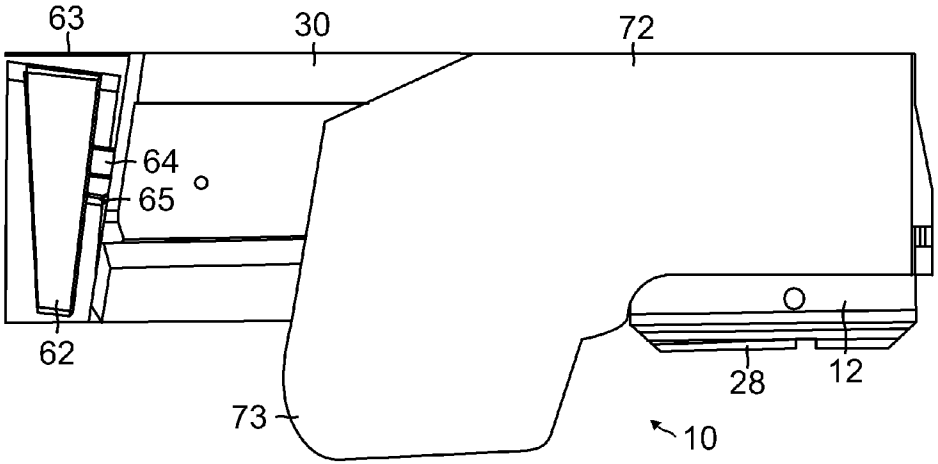
Figure 4E:
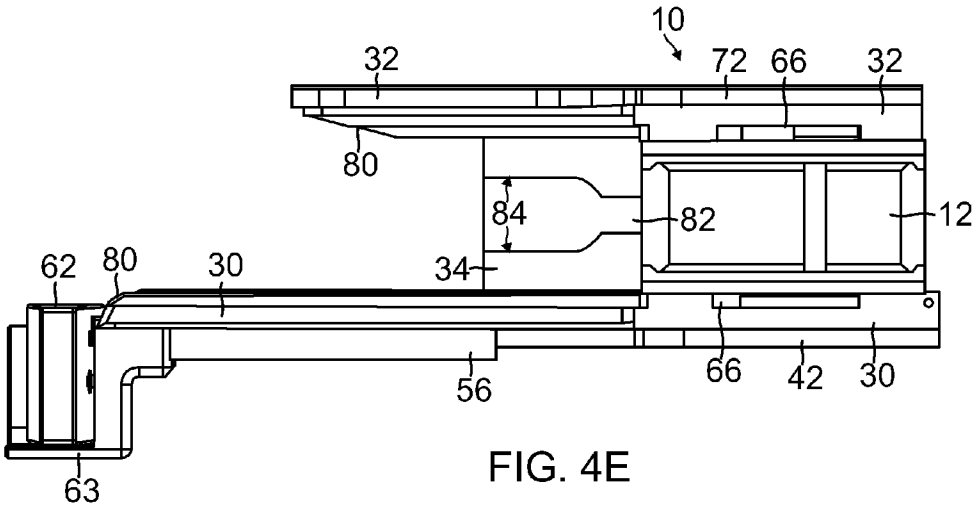
Figure 5:
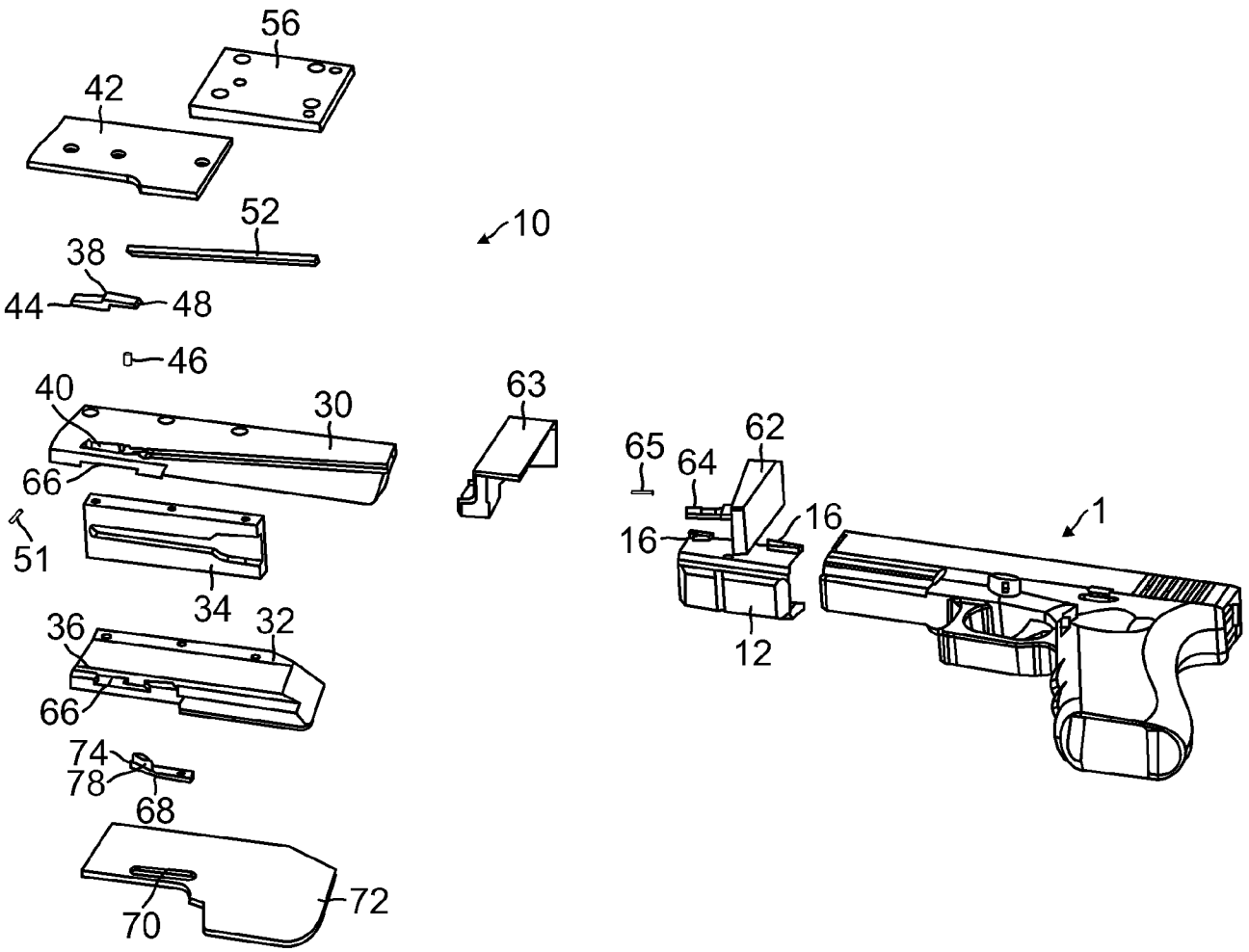
FIG. 5 is an exploded lower, left side, rear perspective view of the holster and associated gun, showing constituent parts of the holster of FIG. 1 A.
Figure 6:
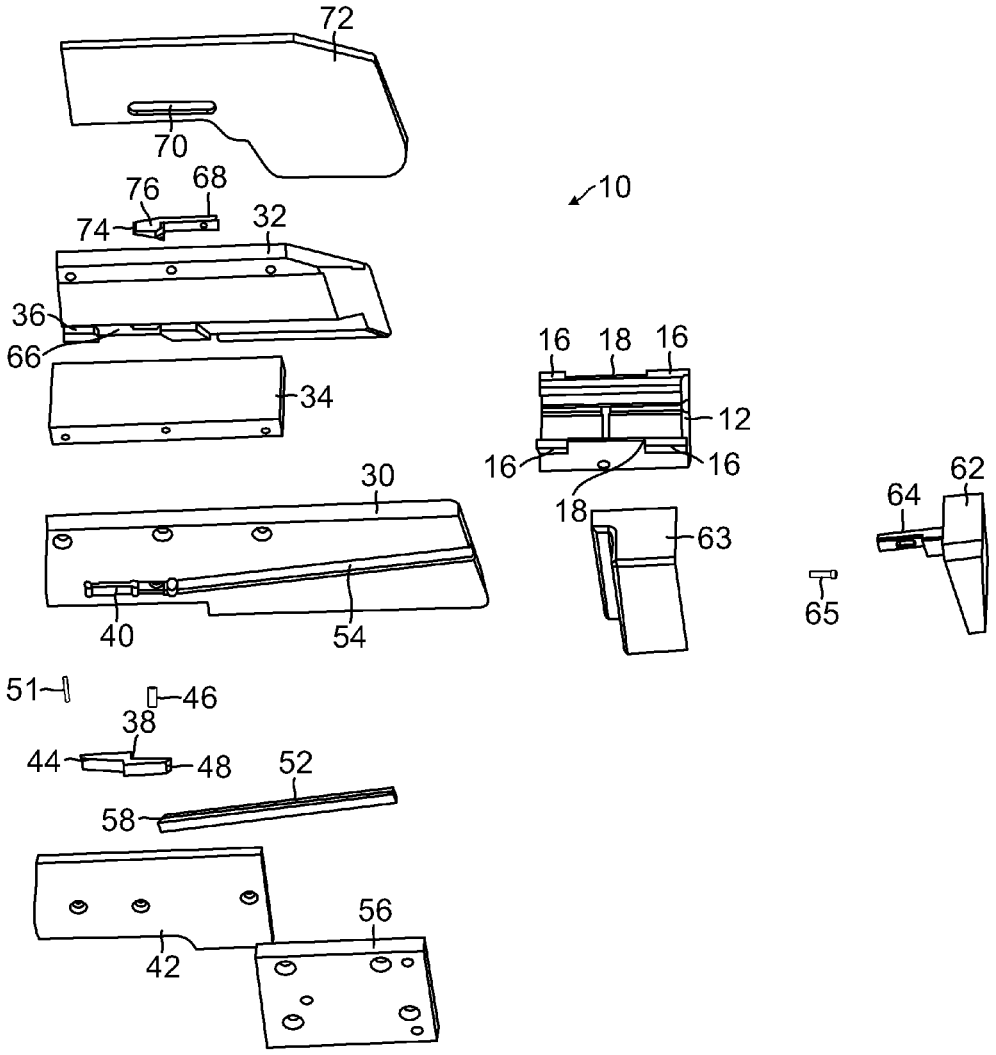
FIG. 6 is an exploded upper, left side perspective view of the holster of FIG. 1A, from which the associated gun has been omitted.
Figure 7:
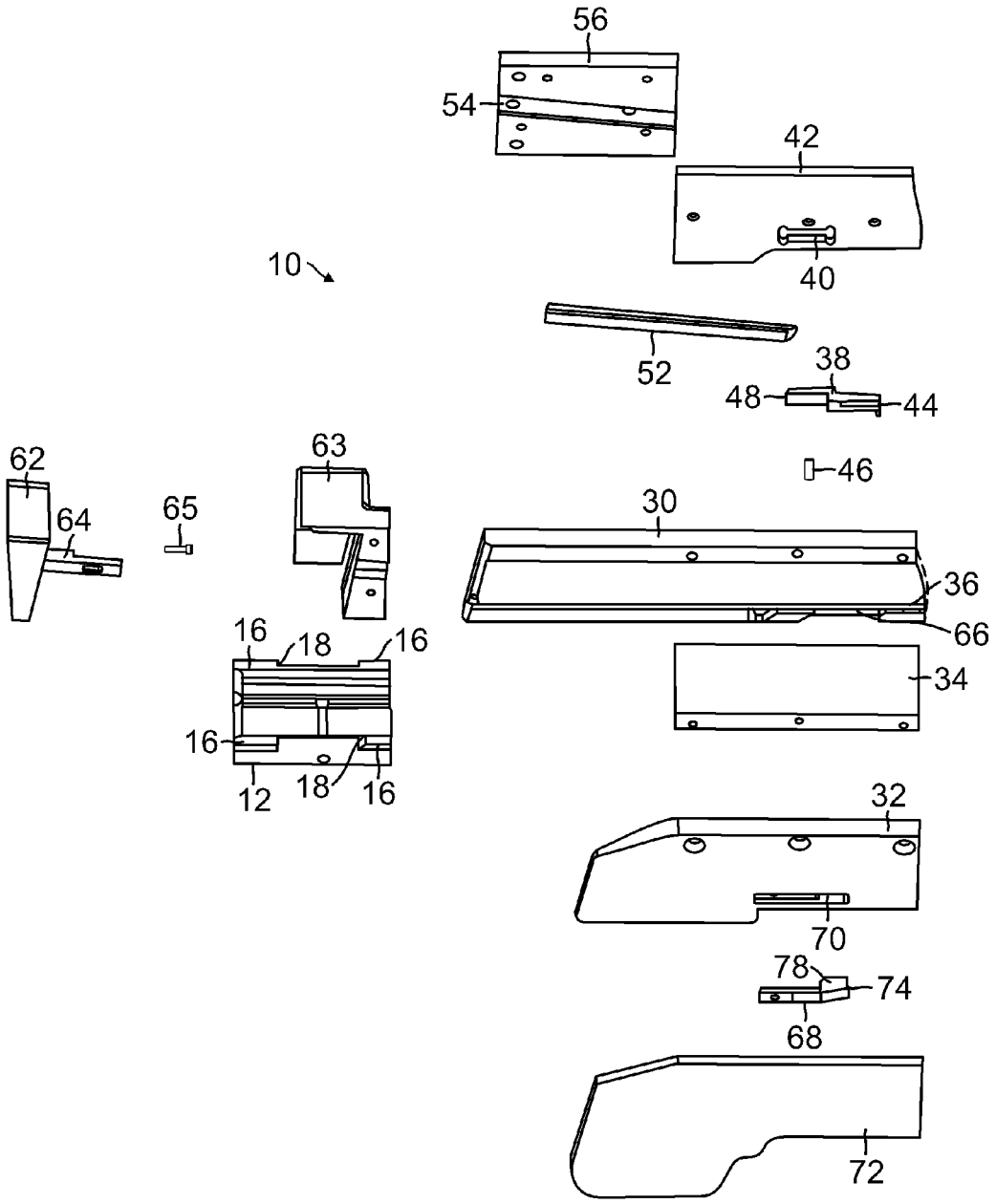
FIG. 7 is an exploded upper, right side perspective view of the holster of FIG. 1A.
Figure 11A:
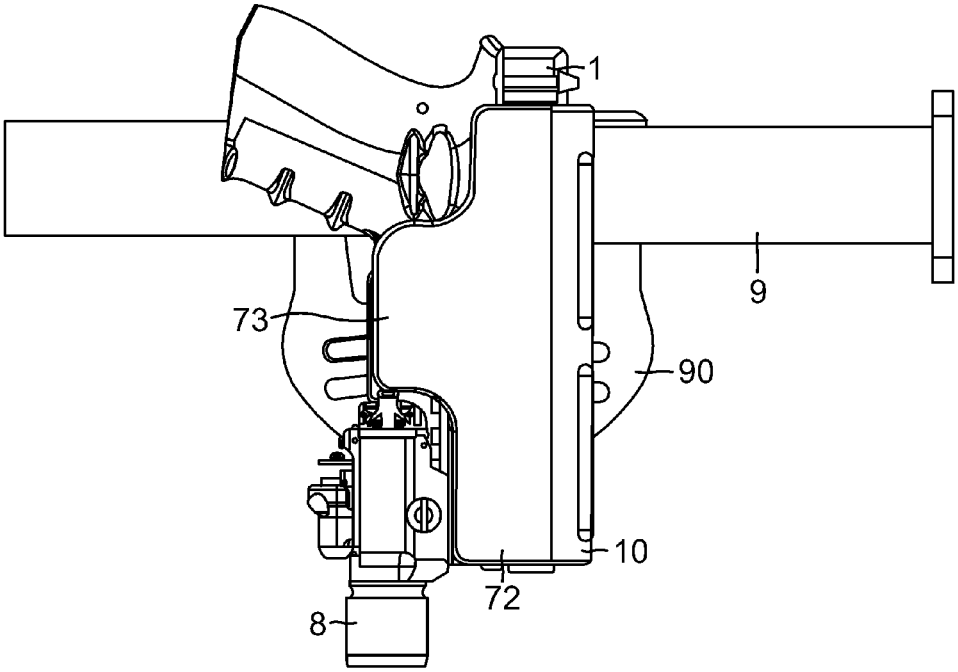
FIG. 11A is a right side elevation view of an example embodiment of a holster in accordance with the present invention, showing the holster coupled to the belt of a wearer and carrying an associated handgun having an accessory mounted thereon.
Figure 11B:
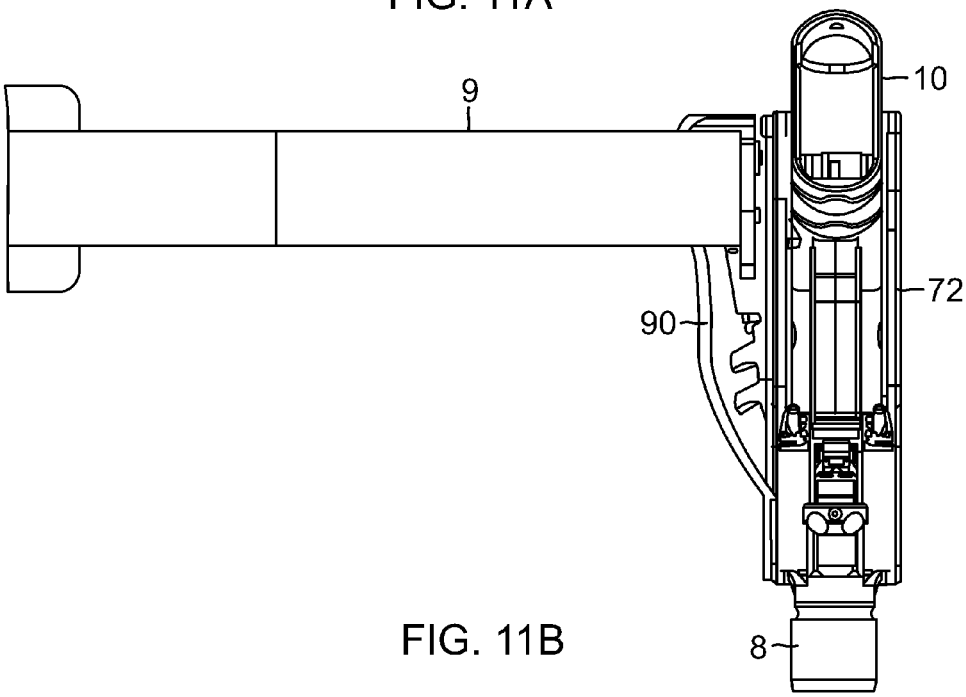
FIG. 11B is a rear end elevation view of the holster, gun and accessory of FIG. 11A.

Turning now to the example holster 10 itself, FIGS. 4A-4F illustrate the holster 10 in an assembled form, and the exploded views of FIGS. 5-7 illustrate its constituent parts and their relative arrangement. With reference to these figures, the example holster 10 can be seen to comprise a generally Π -shaped housing having a pair of side walls or plates 30 and 32 held in spaced opposition to each other by a top plate or spacer wall 34 coupled between corresponding upper edges thereof. It will be appreciated that elements 30, 32, and 34 comprise plates in a "billet" embodiment such that the plates would then be fastened, glued, or welded together to form the housing. In contrast, elements 30, 32, and 34 comprise walls in a molded housing embodiment. As used herein, the term "wall" will refer to either molded or billet embodiments. The remaining description will refer to these elements as "plates" but it will be appreciated that molded embodiments are within the scope of the disclosure. In that regard, the holster 10 can comprise metal, polymer, or fiber components. For descriptive purposes, the side plate 30 is sometimes referred to herein as the "left" or "medial" side plate 30, as it is disposed closest to the medial plane of a wearer when the holster is worn on the wearer's hip, as illustrated in FIGS. 11A and 11B, whereas, the side plate 32 is sometimes referred to as the "right" or "distal" side plate 32.

As illustrated in, e.g., FIGS. 4F, and 5-7, each of the two side plates 30 and 32 has an interior surface containing one of a pair of forwardly extending longitudinal grooves 36 disposed therein, each of which is configured to receive a corresponding one of the longitudinal lands 16 of the adapter 12 in a slide-in engagement. Additionally, as discussed above, rather than rely on a simple but less reliable flap or "over-center" latching mechanism to retain the gun 1 in the holster 10, it is desirable to provide a more "positive" latching mechanism in the holster 10 that acts on the adapter 12 for that purpose, and consequently, it is also desirable to provide a convenient, reliable and quick-acting release mechanism for selectably releasing the gun 1 from the holster 10.

Figure 8:
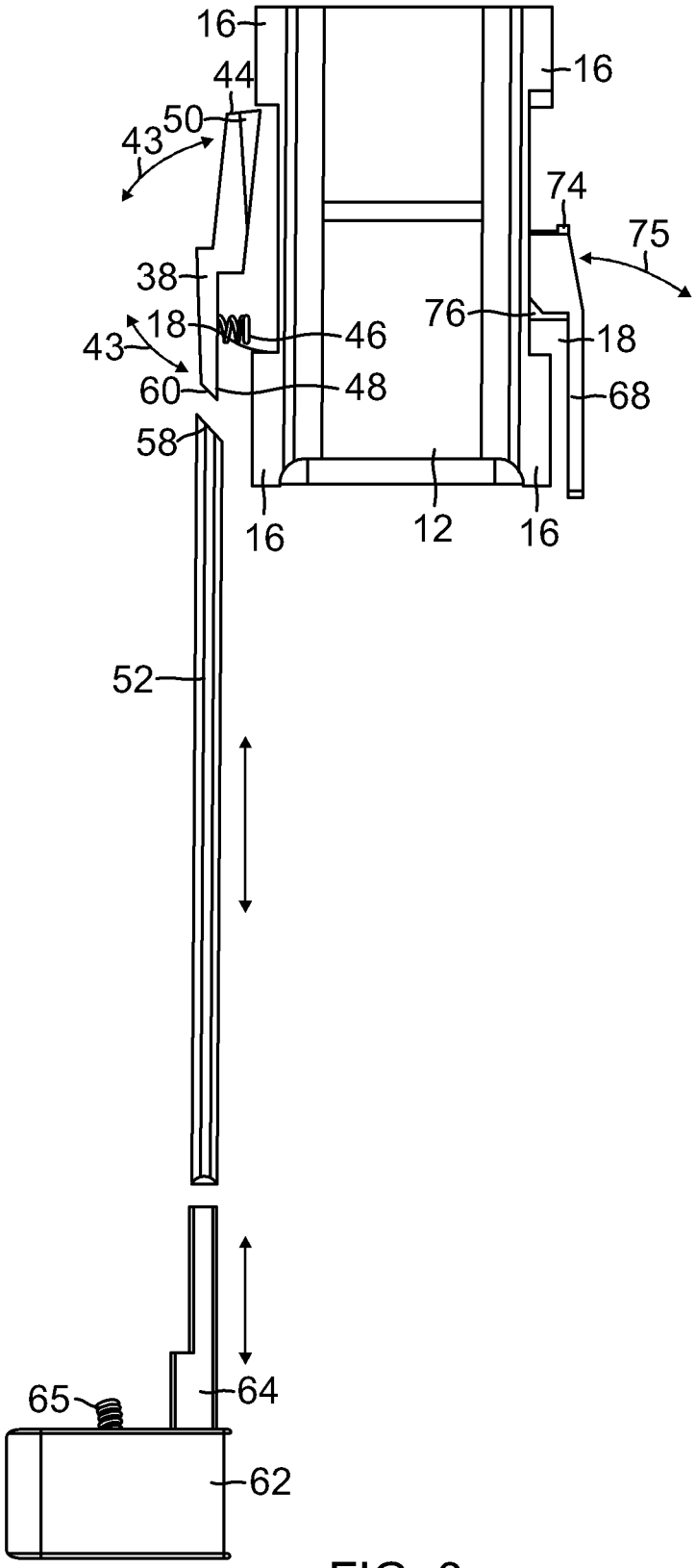
FIG. 8 is a top plan view of the first embodiment holster adapter, showing details of example latching, release and ejection mechanisms usable in association therewith.

FIG. 8 is a top plan view of the holster 10 in which all components of the holster 10, including the two side plates 30 and 32 and the top plate 34, have been omitted for purposes of illustrating the latching and release mechanisms. As illustrated in FIG. 8, in some embodiments, the latching mechanism can comprise an elongated pawl 38 that is pivotally disposed within a recess 40 in the medial or left side plate 30 of the housing and aligned with the longitudinal groove 36 therein. The pawl 38 can be captivated in the recess 40 by, e.g., a front-medial side cover plate 42 coupled to the left or medial side of the medial plate 30 (see, e.g., FIGS. 5-7) for pivotal movement in the direction indicated by the arrows 43.

The pawl 38 has a front end 44 that is resiliently biased, e.g., by a spring 46, into the adjacent longitudinal groove 36, an opposing rear end 48, and a ramp 50 disposed on a lateral surface thereof. The ramp 50 is configured to engage a front end of a corresponding one of the lands 16 of the adapter 12, and as a result, to pivot the front end 44 of the pawl 38 out of the adjacent longitudinal groove 36 when the corresponding land 16 is slid forwardly into the groove 36. In some embodiments, a stop mechanism, such as the roll pin 51 shown in FIGS. 5 and 6, can be included in the holster 10 housing to prevent the adapter 12 from sliding past a front end of the housing.

Thus, when the adapter 12 (and hence, the lands 16 and a gun 1 coupled to the adapter 12) are slid forwardly into the holster 10 such that the longitudinal lands 16 of the adaptor 12 slide into corresponding ones of the longitudinal grooves 36, a front end of the land 16 adjacent to the pawl 38 urges the front end 44 of the pawl 38 to the side, thereby allowing the lands 16 of the adapter 12 to proceed further into the longitudinal grooves 36 in the side plates 30 and 32, until the notch 18 in the lateral edge of the land 16 adjacent to the pawl 38 is positioned adjacent to the front end 44 of the pawl 38, at which point, the front end 44 of the pawl 38 pivots back into the adjacent longitudinal groove 36 so as engage the notch 18 in the land 16 of the adapter 12 and prevent the withdrawal of the adapter 12 (and hence, a gun 1 coupled to it) from the holster 10 until the latching mechanism is intentionally released with a release mechanism. The notch 18 and land 16 thus form a ratchet that engages the pawl 38.

An example embodiment of such a release mechanism is also illustrated in FIG. 8. As shown in FIG. 8, the example release mechanism can comprise a push rod 52 that is slideably disposed in, e.g., a channel 54 defined between a medial wall of the medial side plate 30 and a rear-medial side cover plate 56 (see, e.g., FIGS. 6 and 7) for fore and aft sliding movement behind the pawl 38. As illustrated in, e.g., FIG. 8, the push rod 52 has a front end with a chamfer 58 disposed thereon. The chamfer 58 is configured to pivot the front end 44 of the pawl 38 out of the adjacent longitudinal groove 36 in the direction of the arrow 43 when it is pushed into engagement with a complementary chamfer 60 disposed on the rear end 48 of the pawl 38. This causes the front end 44 of the pawl 38 to pivot out of engagement with the notch 18 in the adjacent land 16 of the adapter 12, thereby enabling the adapter 12 (and hence, a gun 1 coupled to it) to be withdrawn from the holster 10.

In the particular example embodiment illustrated in FIG. 8, a thumb actuated push button 62 is slideably disposed on the medial side plate 30 for fore and aft movement behind the push rod 52. The push button 62 has a forwardly protruding boss 64 with a front end disposed behind the push rod 52. The front end of the boss 64 is configured to engage a rear end of the push rod 52 and to urge the push rod 52 forward when the push button 62 is pressed by the user's thumb, thereby unlatching the adapter 12 for withdrawal from the holster 10. As illustrated in, e.g., FIGS. 5-8, in some embodiments, the thumb actuated push button 62 can be surrounded for protection against dirt or accidental actuation by a push button cover shroud 63 coupled to the side plate 30 and configured to cover at least two sides of the push button 62. A spring 65 disposed between the shroud 63 and the push button 62 can be used to bias the push button 62 in a rearward direction.

As discussed above, it is desirable for the holster 10 to provide for a very short "draw" of the gun 1 therefrom, and this is particularly so when an elongated accessory, such as a silencer or a laser is coupled to the muzzle or receiver 2 of the gun 1. In some embodiments of the present invention, this can be effected by an ejector mechanism that enables the adapter 12, and hence, a gun 1 coupled to it, to be ejected from the bottom of the holster 10 after a rearward (or upward, if the holster 10 is being worn on the wearer's hip) draw or pull of the gun 1 of only about 0.5 inch.

As illustrated in, e.g., FIGS. 5-8, in some embodiments, the "quick draw" ejector mechanism can comprise a slot 66 formed in the lower edge of each of the side plates 30 and 32 that extends between the lower edge of the plate and the longitudinal groove 36 therein. As illustrated in, e.g., FIG. 8, an elongated ejector cam 68 can be pivotally disposed within a recess 70 in one of the side plates, for example, in a recess 70 formed between a distal side surface of the distal side plate 32 and a distal side cover plate 72 disposed thereon, and held thereby in alignment with the adjacent longitudinal groove 36. The ejector cam 68 can have a front end 74 that is resiliently biased into the adjacent longitudinal groove 36. In some embodiments, this can be effected by a spring, as in the case of the latching pawl 38 discussed above. In another advantageous embodiment, the ejector cam 68 can be fabricated of a thermoplastic material having high stiffness, low friction and good dimensional stability, such as polyoxymethylene (e.g., DuPont Delrin) such that ejector cam 68 itself provides the resilience which enables it to be pushed out of the way as the gun 1 is holstered.

In some embodiments, the distal side cover plate 72 can also be provided with a lower extension 73 configured to cover a trigger 3 and/or a trigger guard 4 of the gun 1 (see FIGS. 2A, 2B) when the gun 1 is disposed in the holster 10, as illustrated in FIGS. 11A and 11B. The extension 73 on the cover plate 72 can serve to prevent accidental contact with the trigger 3 of the gun 1 by the user when the gun 1 is being carried in the holster 10.

The front end 74 of the ejector cam 68 can include first and second ramps 76 and 78 respectively disposed on upper and lower surfaces thereof. The first ramp 76 can be configured to engage a front end of a corresponding one of the longitudinal lands 16 of the adapter 12 and to push the front end 74 of the ejector cam 68 laterally and out of the corresponding longitudinal groove 36 (i.e., in the direction of the arrow 75 in FIG. 8) when the corresponding land 16 is slid forwardly into the groove 36, thereby enabling the adapter 12 to bypass the ejector cam 68. The front end 74 of the cam 68 will then snap back resiliently into the longitudinal groove 36 when the notch 18 of the corresponding land 16 is disposed adjacent to the front end 74 of the cam.

With respect to the ejection of the gun 1 from the holster, as the adapter 12 and corresponding land 16 is then slid rearwardly in the corresponding longitudinal groove 36, the second ramp 78 on the lower surface of the front end 74 of the ejector cam 68 can be configured to engage a rear edge of the notch 18 in the lateral edge of the corresponding land 16 of the adapter 12, and thereby urge the adapter 12 (and hence, a gun 1 coupled to it) through the slots 66 at the lower edges of the side plates 30 and 32, and thence, in a direction generally perpendicular to the longitudinal grooves 36 therein, i.e., through the bottom opening of the holster 10. In some embodiments, this ejection of the gun 1 can be effected by a rearward "draw" or "pull" of the gun 1 of only about 0.5 inch.

Advantageously, the adapter 12 and associated gun 1 can be inserted into the holster 10 via the same path by which it is ejected from the holster 10, i.e., into the bottom opening of the holster 10, through the slots 66 on the lower edges of the side plates 30 and 32, and thence, forwardly into the holster 10. This enables the gun 1 to be inserted into the holster 10 in two ways, i.e., through the rear of the holster 10 or through the bottom of the holster 10, as above.

Accordingly, a method embodiment for using the holster 10 of the present invention can comprise the steps of first coupling the adapter 12 to the gun 1, and then inserting the gun 1 and adapter 12 into the holster 10 such that the lands 16 of the adapter 12 are slideably received in corresponding ones of the longitudinal grooves 36 of the side plates 30 and 32 and the latching pawl 38 is engaged with a notch 18 in one of the lands 16 of the adapter 12.

As discussed above, the step of inserting the gun 1 and adapter 12 can comprise either 1) inserting the gun 1 and adapter 13 into a rear end of the holster 10 such that respective ones of front ends of the lands 16 of the adapter 12 enter into corresponding ones of rear ends of the longitudinal grooves 36 of the side plates 30 and 32, or alternatively, 2) inserting the gun land adapter 13 into the bottom end of the holster 10 such that respective ones of front portions of the lands 16 of the adapter 12 pass through corresponding ones of the slots 66 of the side plates 30 and 32 and until an upper surface of each land 16 is in abutment with an upper surface of a corresponding one of the longitudinal grooves 36, and then sliding the gun 1 and adapter 12 forwardly in the grooves 36.

As illustrated in, e.g., FIG. 4E, as an aid to inserting the gun 1 and adapter 12 into the rear end of the holster 10 (or the "top" end thereof if the holster 10 is being worn upright on the wearer's hip), the medial and distal side plates 30 and 32 can be provided with inwardly sloping surfaces 80 on respective ones of the rear ends thereof, and the top or spacer plate 34 can include an elongated slot 82 having an enlarged entryway 84 extending forwardly in a lower surface thereof, the slot 82 and entryway 84 being adapted to receive a blade sight 5 (see FIGS. 2A, 2B) disposed on a front end of an upper surface of the slide 6 of the gun 1 in a slide in engagement.

As discussed above, embodiments of the holster 10 of the present invention can be used with a wide variety of handgun types. For example, FIG. 9 illustrates an alternative embodiment of a holster adapter 86, shown coupled to a lower surface of a front end portion of the receiver of another type of handgun 7, viz., a Colt M1911 pistol. As may be seen in the various elevation and plan views of the alternative adapter 86 in FIGS. 10A-10E, the adapter 86 can incorporate several of the features of the adapter 12 of FIGS. 3A-3E, such as the accessory mounting rail 28 and longitudinal lands 16 of the latter, as well as some additional features not found on the adapter 12, such as a positioning and mounting cup 88 disposed at the rear of the adapter 86 that is configured to enable the adapter to mount to the front surface of the trigger guard of the gun 7.

FIGS. 11A and 11B are right side and rear end elevation view of an example embodiment of a holster 10 in accordance with the present invention, showing the holster 10 coupled to the belt 9 of a wearer and carrying an associated handgun 1 having an accessory, viz., a laser sighting device 8, mounted thereon. As illustrated in these figures, the holster can include a belt loop structure 90 coupled to a proximal side of the holster 10, e.g., to the rear-proximal side cover plate 56, to enable the holster 10 to be worn on a belt 9.

Second Example Embodiment

Figure 12:
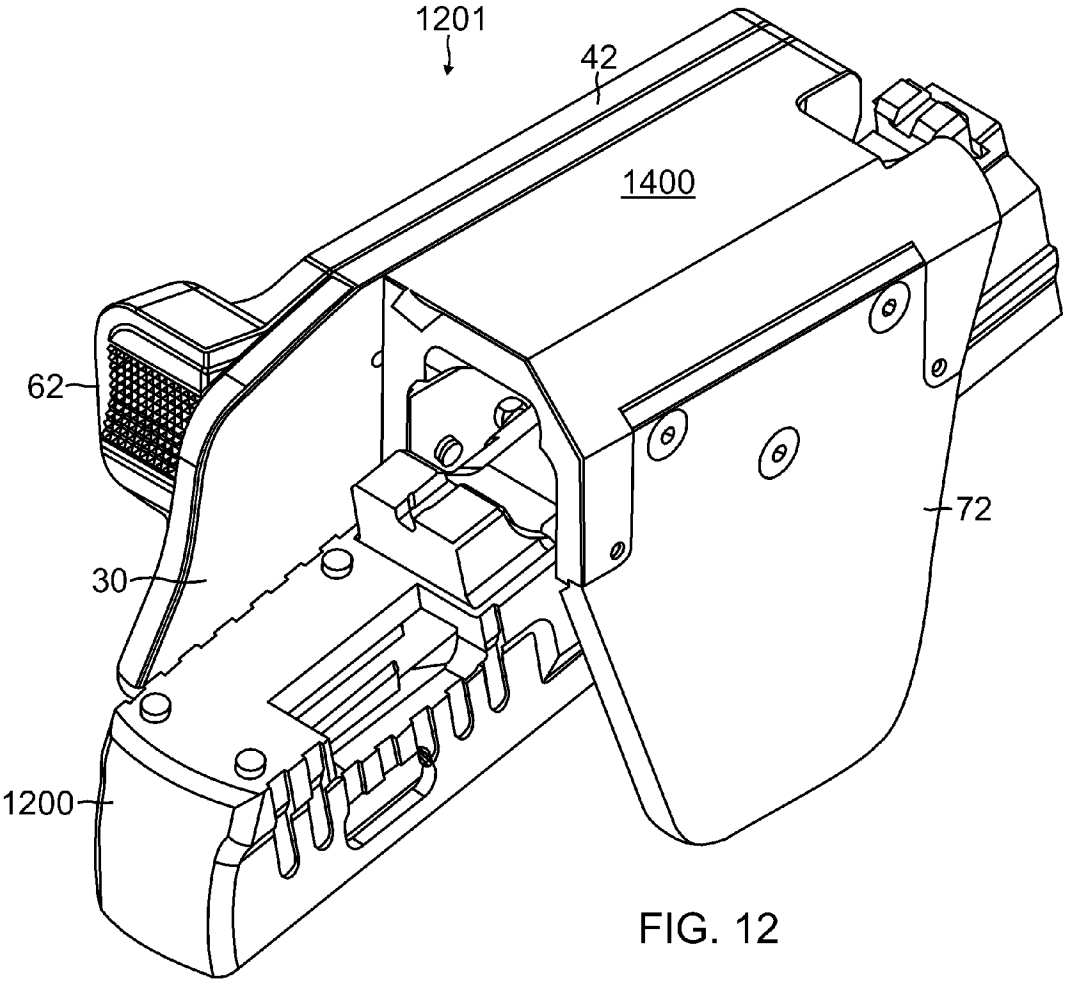
FIG. 12 is a perspective view of a holster and gun slide in accordance with a second embodiment.
Figure 13:
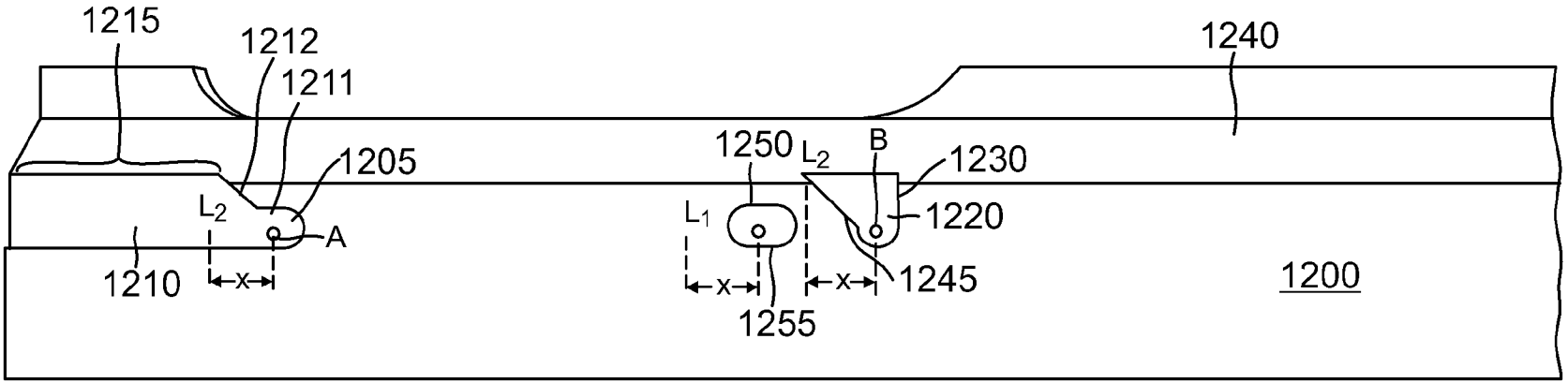
FIG. 13 is a plan view of the gun slide of FIG. 12.
Figure 14:
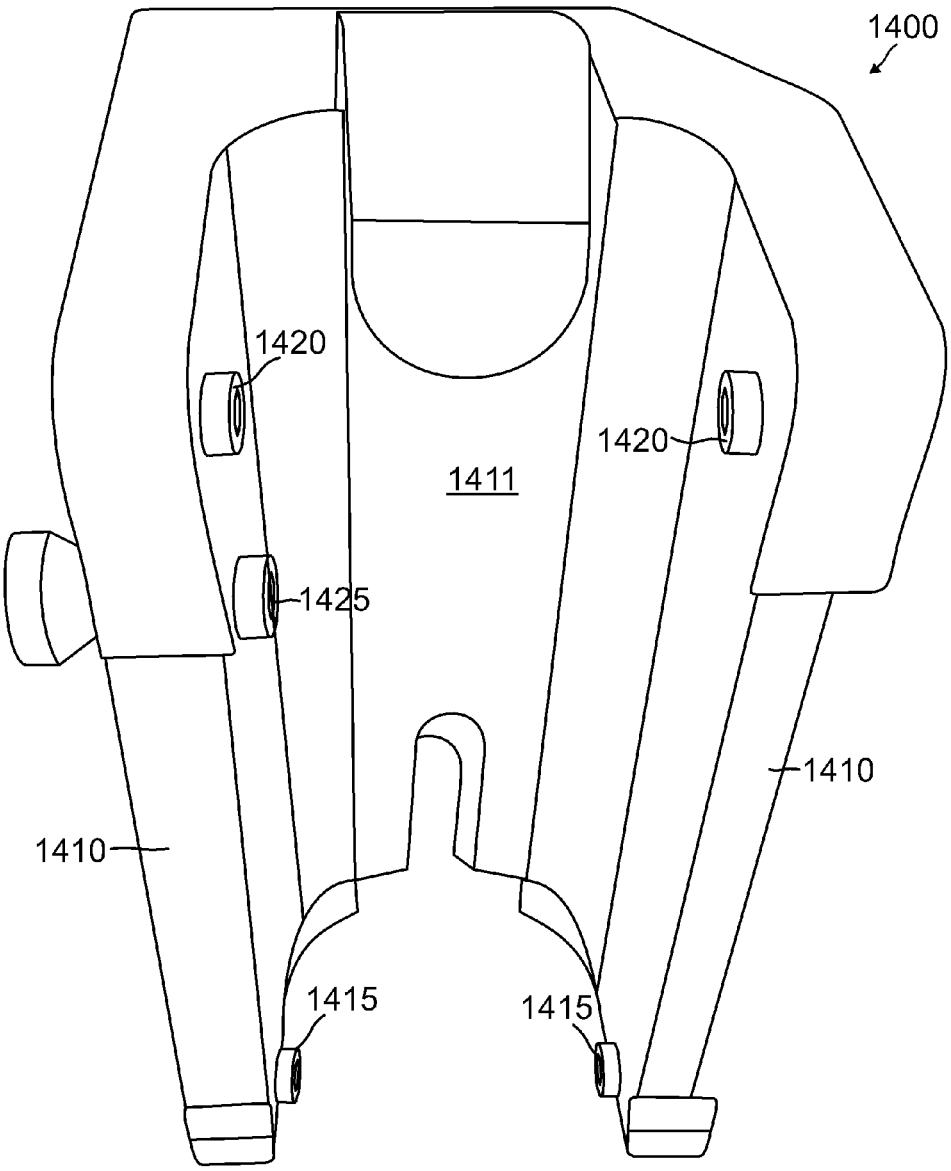
FIG. 14 is a perspective view of the adapter in the holster of FIG. 12.

In the second embodiment, a handgun component is configured with receiving elements such as slots or recesses that receive corresponding projecting element on the holster. The following discussion addresses an embodiment in which the hand gun slide is configured with the receiving elements. But it will be appreciated that other handgun components, such as a laser sight, can instead be configured with the receiving elements. A suitable handgun component is sufficiently elongated to include the necessary receiving features. Turning now to FIG. 12, a handgun slide 1200 is received by an adapter 1400 within a holster 1201. A plan view of the slide 1200 is shown in FIG. 13. Similarly, a perspective view of the adapter 1400 is shown in FIG. 14. The adapter 1400 includes a pair of opposing sidewalls 1410 joined by a top plate 1411. There is no bottom plate such that the combination of sidewalls 1410 and top plate 1411 form a longitudinally-extending cavity having an inverted-U-shaped cross section that is open on the bottom side for receiving the slide 1200.

Figure 15:
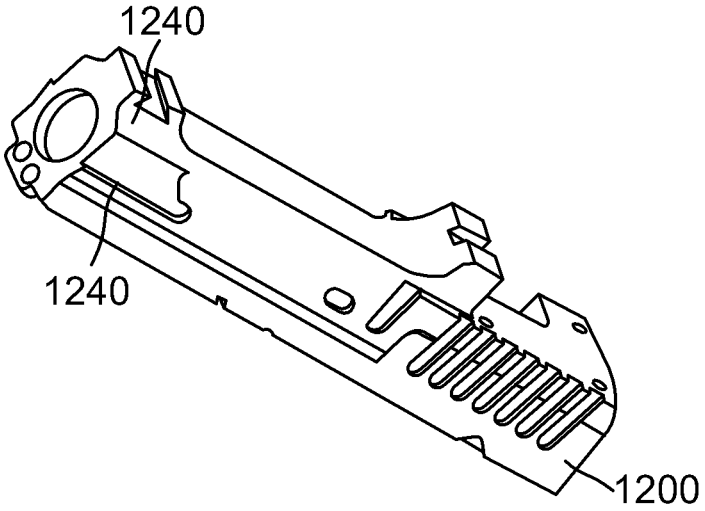
FIG. 15 is a perspective view of the gun slide of FIG. 13.

The adapter 1400 includes a plurality of projecting features that engage with corresponding receiving features in the slide 1200. For example, the adapter 1400 may include a plurality of guide pins that project inwardly from the inner surface of the sidewalls 1410. In one embodiment, these guide pins comprise a pair of distal pins 1415 and a pair of proximal pins 1420. The slide 1200 includes a corresponding plurality of slots on each slide sidewall adapted to engage with guide pins 1415 and 1420. To receive the distal pins 1415, the distal portion of each slide sidewall has a distal slot 1205. A bottom guide wall 1210 for distal slot 1205 longitudinally extends to the distal end for slide 1200. FIG. 15 is a perspective view of slide 1200 to better illustrate bottom guide wall 1210. An upper guide wall for slot 1205 includes a relatively short section 1211 that is parallel with the guide wall 1210. A majority of the upper guide wall for the slot 1205 forms an angled portion 1212 with respect to the bottom guide wall 1210, and thus does not extend to the distal end of the slide 1200. A distal portion 1215 of the slot 1205 is thus open at the top and only closed at the bottom by the bottom guide wall 1210. In this fashion, a user may readily engage the slide 1200 within the adapter 1400 as follows.

FIG. 16*a* shows a user inserting the gun slide 1200 distally within the open cavity of the holster 1201. For clarity of illustration, the remaining portions of the handgun are not shown except for the slide 1200. Because the holster 1201 is closed at the top such that a user must insert the gun from below with respect to this closed top, the user will typically orient the gun barrel slightly at a an angle with respect to the longitudinal axis of the holster 1201. Referring again to FIGS. 13-15, each lower guide wall 1210 will thus engage with its corresponding distal pin 1415. As the user inserts the gun more distally into the holster, each pin 1415 will thus hit a back wall of its corresponding slot 1205 such that a central axis of the pin 1415 will be located at position "A" of FIG. 13. The back wall of each slot 1205 thus prevents any further insertion of slide 1200 distally within the holster 1201. Each of these back walls thus acts as a stop with respect to any further insertion of the gun into the holster. FIG. 16*b* illustrates the orientation of the slide 1200 in holster 1201 at this point.

Since the pins 1415 are engaged with the slots 1205 at position A, the proximal portion of the gun slide 1200 can be rotated towards the holster 1201, as indicated by arrow 1600 in FIG. 16*b* to be fully engaged within holster 1201 as shown in FIG. 16*c*. Referring again to FIGS. 13-15, the adapter 1400 includes a pair of proximal pins 1420 inwardly projecting from respective inner surfaces of sidewalls 1410. The slide 1200 includes a pair of proximal slots 1220 configured to receive corresponding ones of the proximal pins 1420. Each proximal slot 1220 includes a generally vertically-oriented back guide wall 1230. With respect to each proximal slot 1220, the back guide wall 1230 functions to guide its corresponding pin 1420 as the user rotates the proximal portion of the slide 1200 into the holster 1201, as discussed above with respect to FIG. 16*b*. The axis of rotation is thus with regard to the stops formed by the back walls of slots 1205. In the fully-engaged position of FIG. 16*c*, a central axis of the pin 1420 is then located at position "B" in the slot 1220.

To lock the slide 1200 into the holster 1201 in this fully-engaged position, the adapter 1200 may include one or more locking pins. In the embodiment shown in FIGS. 12-16*c*, the adapter 1200 includes just one locking pin 1425. The locking pin 1425 is resiliently biased to project inwardly from an inner surface of an adapter sidewall 1410. The slide 1200 includes a chamfer 1240 disposed between its upper surface and its sidewalls. The chamfer 1240 thus engages the pin 1425 as the slide 1200 is locked into its fully-engaged position within the holster 1201 such that the locking pin 1425 is pressing against the slide sidewall at the point 1250. As the user continues to rotate the slide 1200 into the fully-engaged position, the locking pin 1425 becomes aligned with a latching recess 1255 on the slide 1200. At this point, the resilient bias on the locking pin 1425 forces the pin 1425 into the latching recess 1255 such that the slide 1200 (and thus the corresponding hand gun) is fully-engaged within the holster 1201 and locked into position.

It will be appreciated that alternative embodiments can be constructed in which the locking pin also functions as a guide pin. For example, the recess 1255 could be eliminated such that one of the slots 1220 would also include a recessed portion. Such a slot would then serve both a guiding function during engaging and disengaging the weapon from the holster, as well as a latching function. Thus, although the following discussion is directed to an embodiment with separate locking and guide pins, it will be appreciated that the disclosure encompasses alternative embodiments with a dual locking and guiding features.

Figure 17:
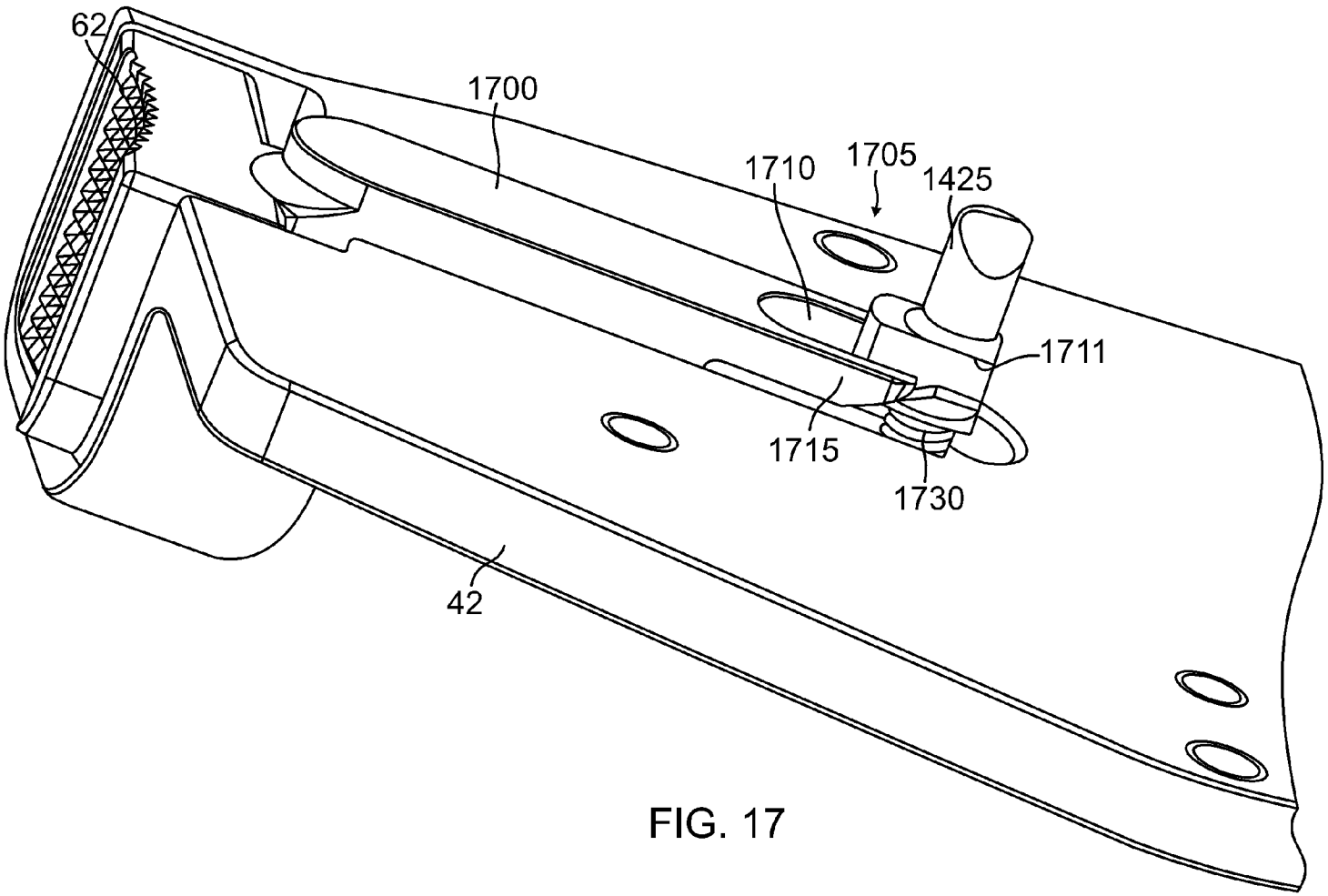
FIG. 17 is a perspective view of the linear cam mechanism within the holster of FIG. 12.

To disengage the slide 1200 from its full-engaged position within the holster 1201, a user needs some mechanism for withdrawing the locking pin 1425 from the latching recess 1255. This disengagement is analogous to that described earlier with regard to the first embodiment (FIGS. 1-11*b*). Because of this similarity, the following discussion is merely a summary, in that analogous components have already been described with regard to the first embodiment. Thus, as can be seen in FIG. 12, the holster 1200 can include a pushbutton 62. The adapter 1400 connects to a distal side cover plate 72 that can also function as a trigger guard. In addition, the adapter 1400 connects to a proximal side cover plate 30. An additional proximal side cover plate 42 connects to the plate 30 and houses the push button 62. A perspective view of the distal side of the additional proximal side cover plate 42 is shown in FIG. 17. The push button 62 connects to a shaft 1700 of a linear cam 1705. The linear cam 1705 includes a recess or slot 1710 for receiving a flat-sided main body 1711 of the locking pin 1425. The linear cam 1705 thus forms a pair of wedge-shaped arms 1715 about the recess 1710. These wedge-shaped arms 1715 engage corresponding cam surfaces on the main body 1711 of the locking pin 1425. As a user presses the push button 62 to withdraw the locking pin 1425 from the latching recess 1255 (FIG. 13), the wedge-shaped arms 1715 thus actuate the locking pin 1425 to compress a spring 1730. The spring 1730 would otherwise resiliently bias the locking pin 1725 towards the latching recess 1255. The push button 62 itself is resiliently biased (for example, by another spring, not illustrated) so that when a user releases the push button 62, the linear cam 1705 withdraws from engagement with the locking pin 1425 so that the spring 1730 can again resiliently bias the locking pin 1425 into latching recess 1255 on the slide 1200. It will be appreciated that other cam mechanisms can be used to linearly displace the locking pin 1425 in this fashion. As also shown in FIG. 17, the distal end of the locking pin 1425 can be wedge-shaped in a fashion complementary to that of the chamfer 1240 on the slide 1200.

Referring again to FIG. 13, the proximal slots 1220 include an angled distal guide wall 1245. With the locking pin 1425 withdrawn from the latching recess 1255, each proximal pin 1420 (see FIG. 14) will be guided by a corresponding angled distal guide wall 1245 as a user withdraws the gun from the holster. The user need merely withdraw the gun the distance "x" shown in FIG. 13 from latched position B until the angled distal guide wall 1245 is completely free of the pin 1420. A similar release occurs with regard to the angled upper guide wall 1212 of each slot 1205 to release from corresponding ones of the distal pins 1415 (see FIG. 14). The distance "x" shown in FIG. 13 may be relatively short, such as ½ inch, or even ⅜ inch or less. In this fashion, a user need merely withdraw the gun this short distance from the holster after pressing the push button 62 to release the gun from the holster. Such a "quick draw" is quite advantageous in combat or law enforcement situations. Despite such a quick release, the gun is secured with relative ease as described with regard to FIGS. 16*a-c*. A handgun component such as a slide (or an alternative gun component such as a laser sight) is readily machined with the necessary slots and recesses, which lowers construction costs. Accordingly, the embodiments disclosed herein are quite advantageous. As discussed with regard to the first embodiment above, the holster 1201 can be constructed from discrete parts or may be formed using a variety of molding processes.

Third Example Embodiment

Figure 18:
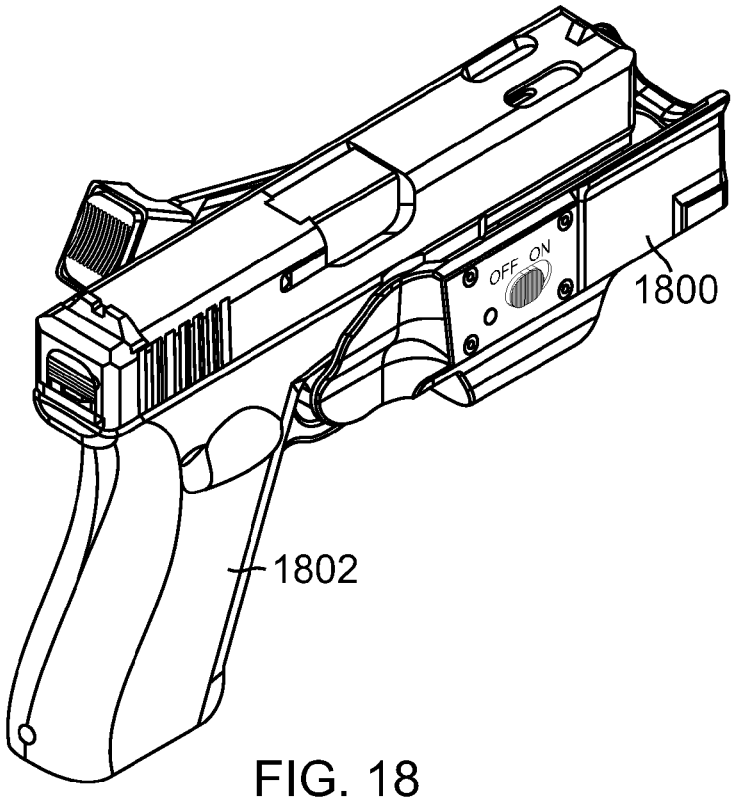
FIG. 18 is a upper, right side, rear perspective view of third example embodiment of a quick draw holster and associated handgun in accordance with the present invention.
Figure 19:
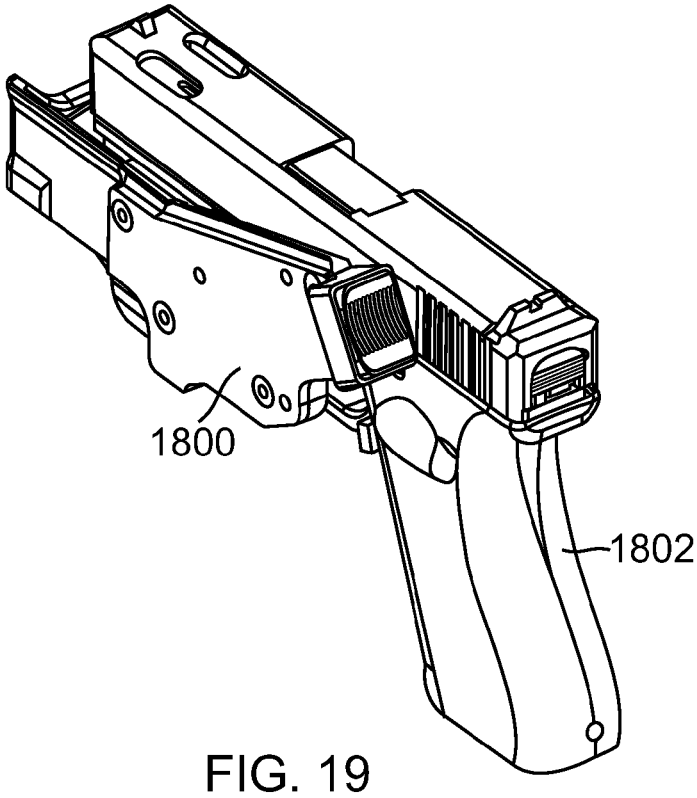
FIG. 19 is an upper, left side, rear perspective view of the third example holster and gun of FIG. 18.
Figure 20:
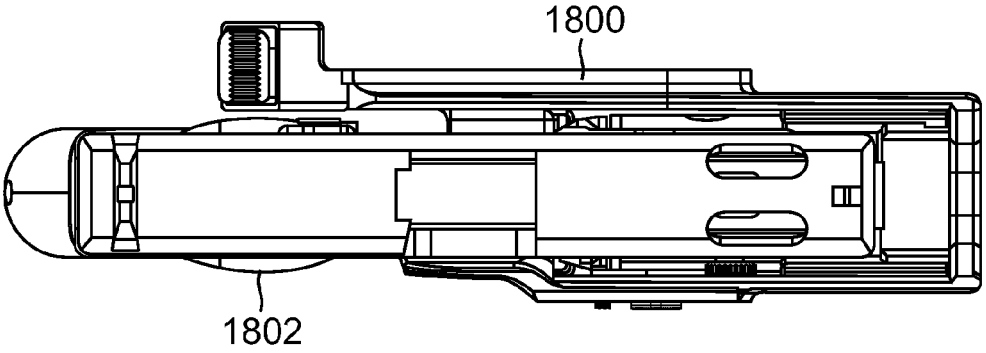
FIG. 20 is a top plan view of the third example holster and gun.
Figure 21:
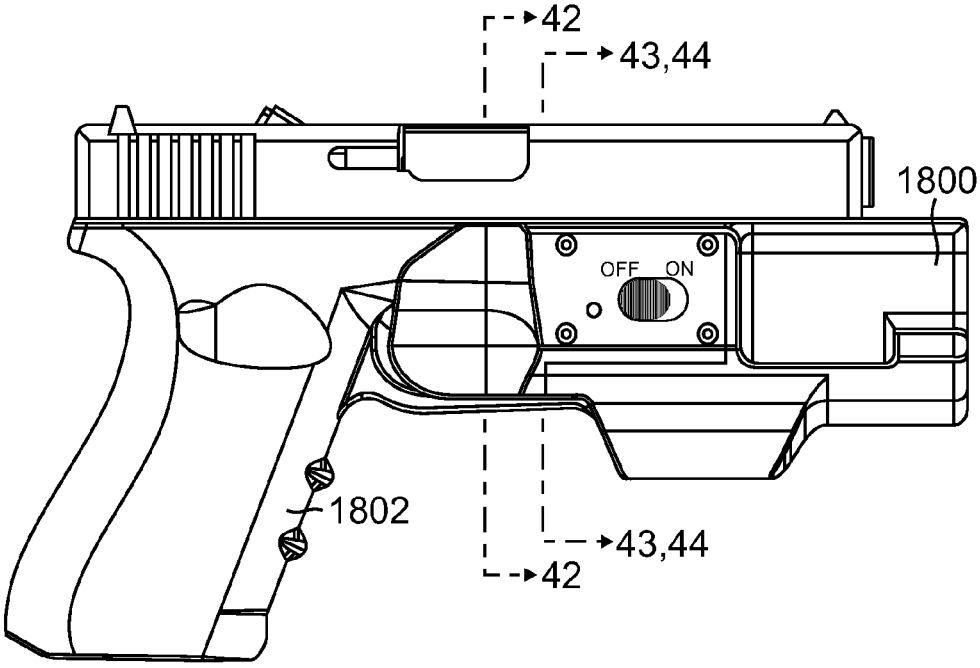
FIG. 21 is a right side elevation view of the third example holster and gun.
Figure 22:
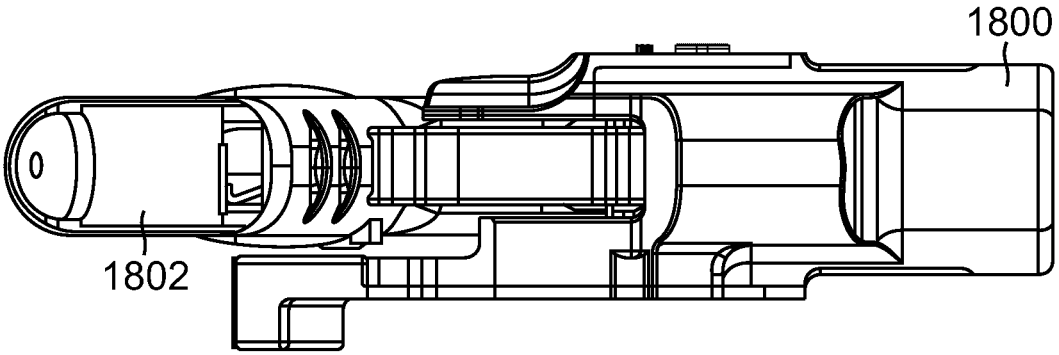
FIG. 22 is a bottom plan view of the third example holster and gun.
Figure 23:
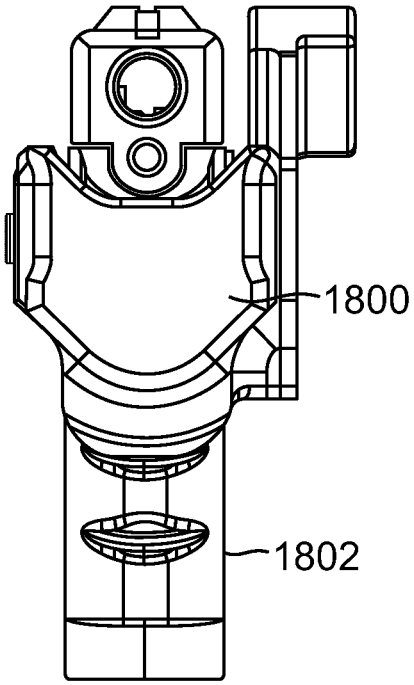
FIG. 23 is a muzzle end elevation view of the third example holster and gun.
Figure 24:
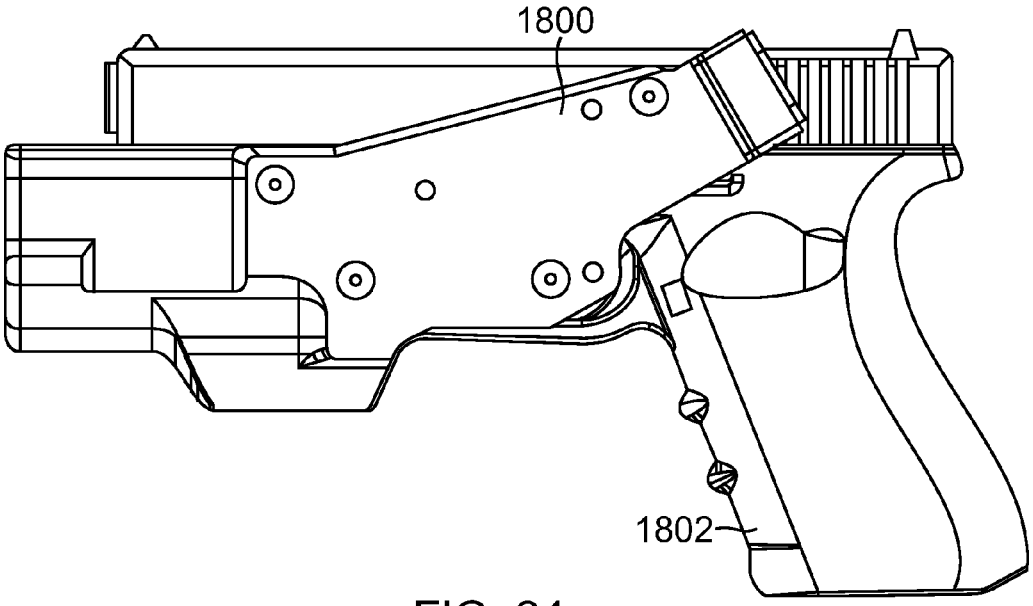
FIG. 24 is a left side elevation view of the third example holster and gun.
Figure 25:
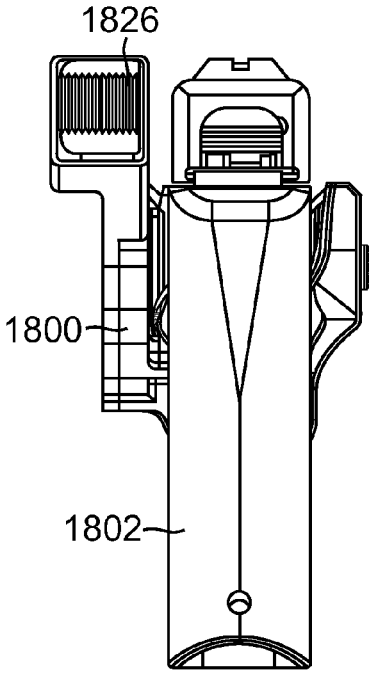
FIG. 25 is a rear end elevation view of the third example holster and gun.

FIG. 18 is a upper, right side, rear perspective view of third example embodiment of a quick draw holster 1800 and associated handgun 1802 in accordance with the present invention, and FIG. 19 is an upper, left side, rear perspective view thereof. In the particular embodiment illustrated, the handgun 1802 consists of a Glock semiautomatic pistol, similar to that described above in connection with the first example embodiment, although, as those of some skill will understand, the holster 1800 is, like the above embodiments, easily modified to accommodate other types of handguns. Indeed, the example quick draw holster 1800 incorporates many of the same features and advantages of the first and second embodiments above, and accordingly, a more detailed description of these features, where duplicative, is omitted for brevity.

However, it may be noted in the following that the example holster 1800 differs from the first and second embodiments described above in at least three particulars, viz., 1) the associated handgun 1802 is drawn from the top (or front, if the holster 1800 is being worn on the hip) of a U-shaped housing 1803, rather than from the bottom (or rear) of Π -shaped housing, as in the first two embodiments; 2) the holster 1800 makes use of retention mechanism of the type described above in which the "projecting element" is disposed on the holster and the "receiving element" is disposed in a hand gun component, and in particular, in a light accessory, such as a light and/or a laser sighting device, and 3) the holster 1800 is capable, at the user's option, of activating the light accessory when the gun 1802 is drawn from the holster 1800, and of deactivating it when the gun 1802 is inserted in the holster 1800.

FIGS. 20-25 are top plan, right side elevation, bottom plan, front end elevation, left side elevation and rear end elevation views of the holster 1800 holstering the associated gun 1802, respectively.

Figure 26:
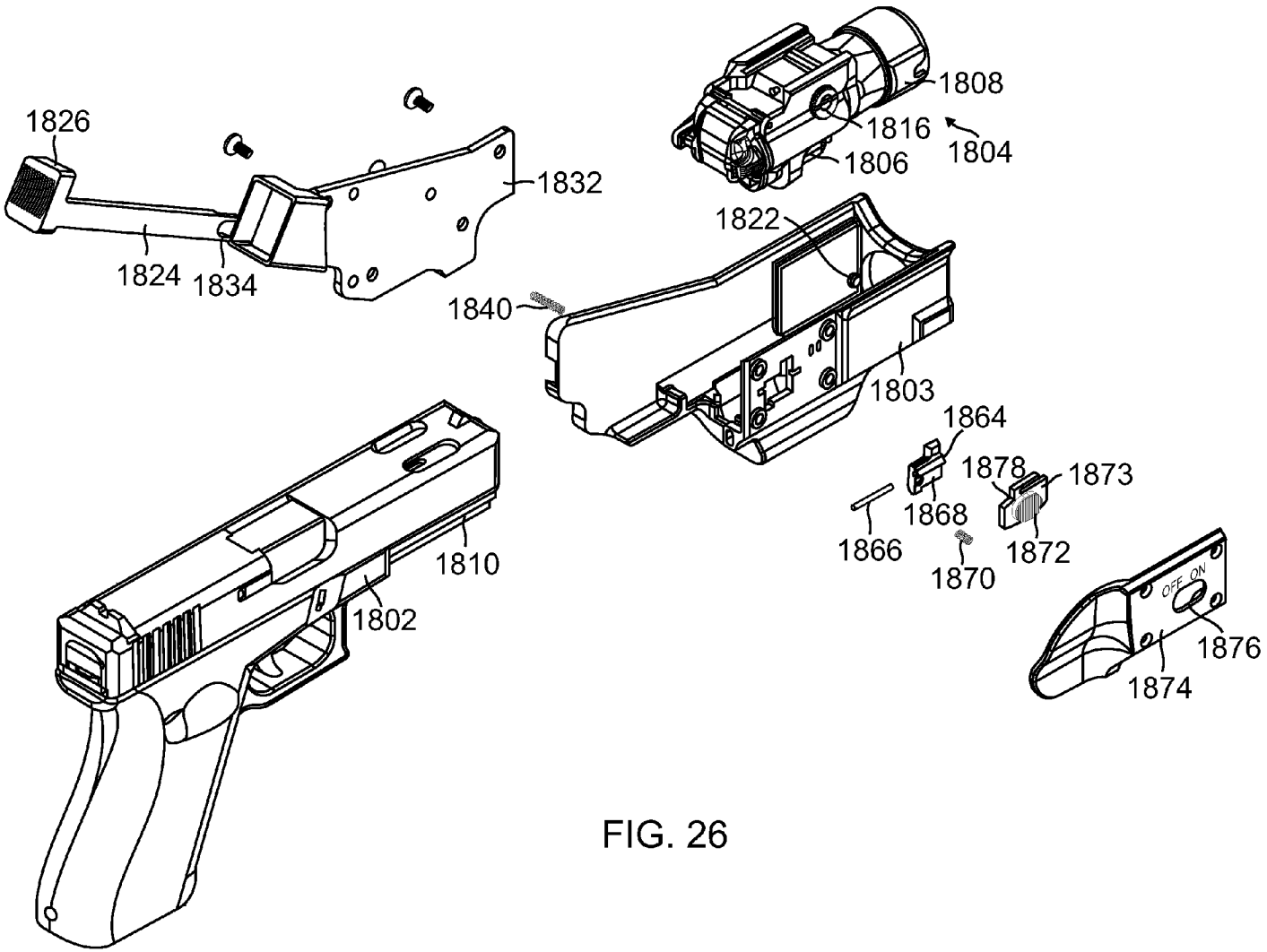
FIG. 26 is an upper, right side, rear exploded perspective view of the third example holster and gun, showing a light accessory associated therewith.
Figure 27:
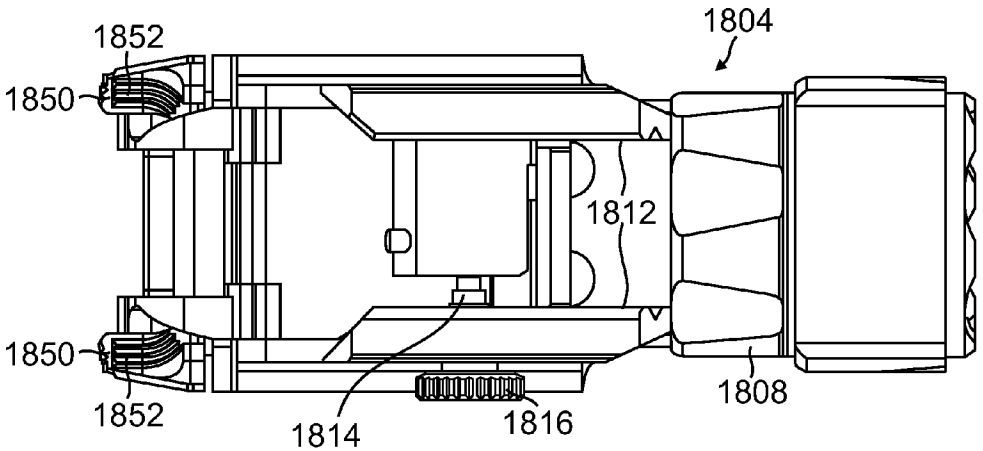
FIG. 27 is a top plan view of the light accessory.

FIG. 26 is an upper, right side, rear exploded perspective view of the example holster 1800 and gun 1802, showing the light accessory 1804 associated therewith, which in this particular example embodiment, comprises an off-the-shelf weapon light comprising a combination of an "over-under" white light illuminator or flashlight component 1808 and a red light emitting diode (LED) targeting component 1806 vended by SureFire, LLC, Fountain Valley, Calif., Model X400. In some embodiments, other light accessories may be used such as, for example, SureFire Model X300, or other lighting devices and/or targeting components available from SureFire or other manufacturers where appropriate. The light accessory 1804 is illustrated in the top plan, right side elevation, bottom plan, front elevation, left side elevation and rear elevation views of FIGS. 27-32, respectively. Although various features will be described in relation to light accessory 1804, such features may be applied to any type of accessory device attached to gun 1802 where appropriate. Together, the gun 1802 and the accessory device may be referred to as an assembly, a gun assembly, and/or a handgun assembly. In this regard, any of the various features described herein may be applied to any such assemblies where appropriate (e.g., applied to the gun 1802 and/or the accessory device).

The light accessory 1804 couples to the handgun 1802 in a manner similar to that employed with the adapter 12 discussed above in connection with the first embodiment. In particular, in FIG. 26, the gun 1802 incorporates a pair of longitudinal grooves (see also 22 in FIG. 2B) on the lower surface of a front end portion of the gun's receiver that define a mounting rail 1810 for mounting accessories, such as the light accessory 1804. As can be seen in, e.g., FIGS. 30, 32 and 33, the light accessory 1804 includes a pair of grooves 1812 that are complementary to the mounting rail 1810 on the gun 1802. A screw 1814 (FIG. 31) having a knurled head 1816 can be tightened using either the fingers or a screwdriver to advance one of the grooves 1812 toward the other so as to clamp the light accessory 1804 firmly to the mounting rail 1810, and hence, to the gun 1802. The light accessory 1804 can then be used as a mechanism for receiving protruding features on the holster 1800 to guide gun 1802 into the holster 1800 and the releasably hold it there.

Figure 28:
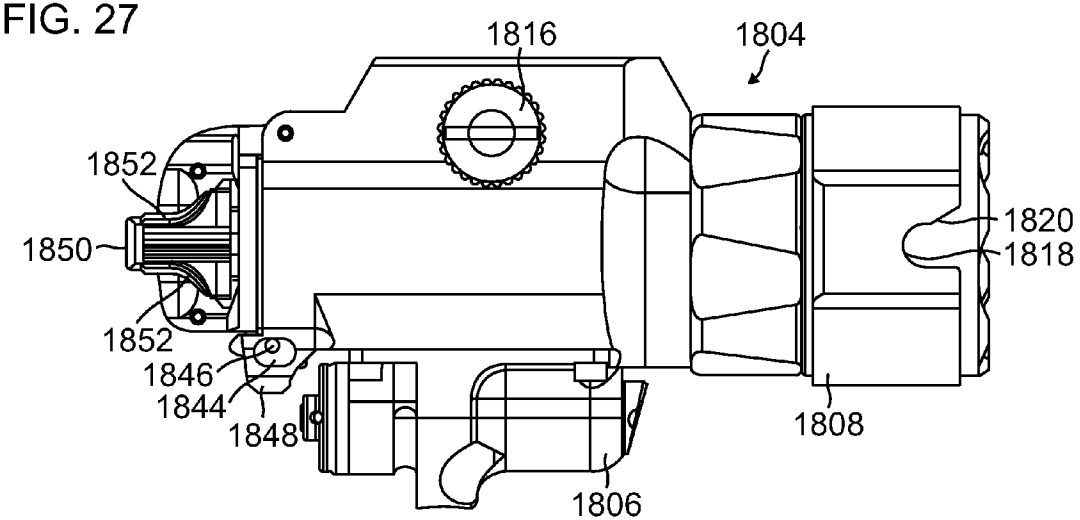
FIG. 28 is a right side elevation view of the light accessory.
Figure 29:
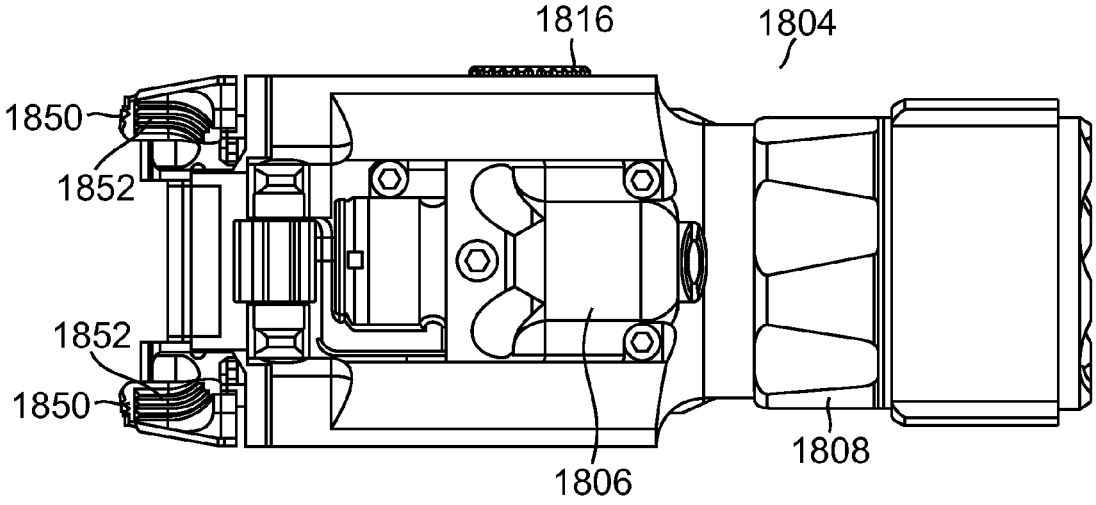
FIG. 29 is a bottom plan view of the light accessory.
Figure 30:
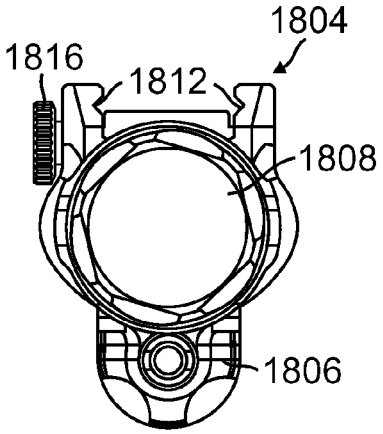
FIG. 30 is a front end elevation view of the light accessory.
Figure 31:
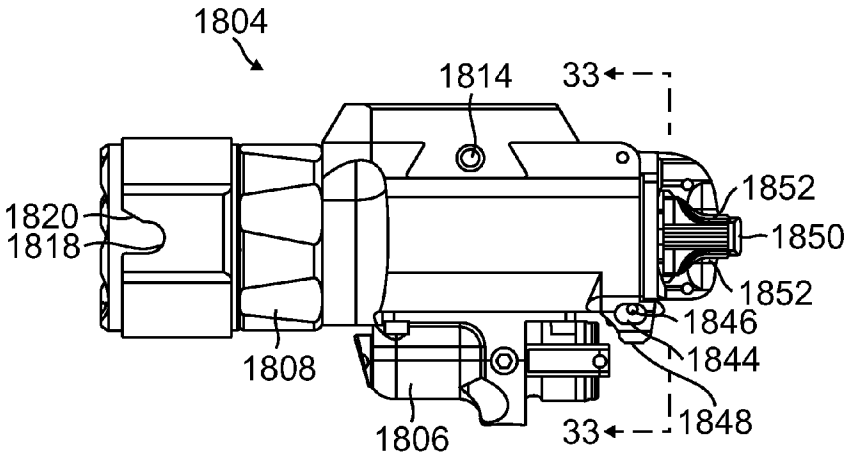
FIG. 31 is a left side elevation view of the light accessory.
Figure 32:
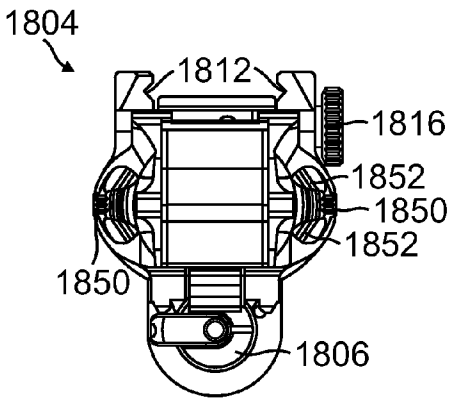
FIG. 32 is a rear end elevation of the light accessory.
Figure 36:
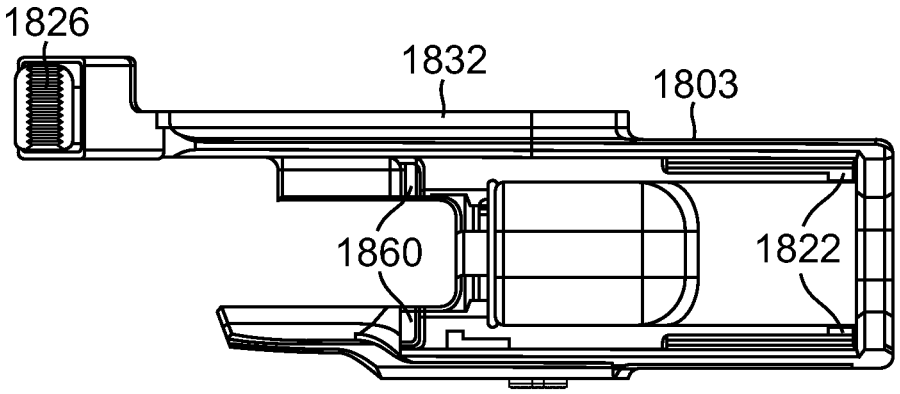
FIG. 36 is a top plan view of the third example holster.
Figure 37:
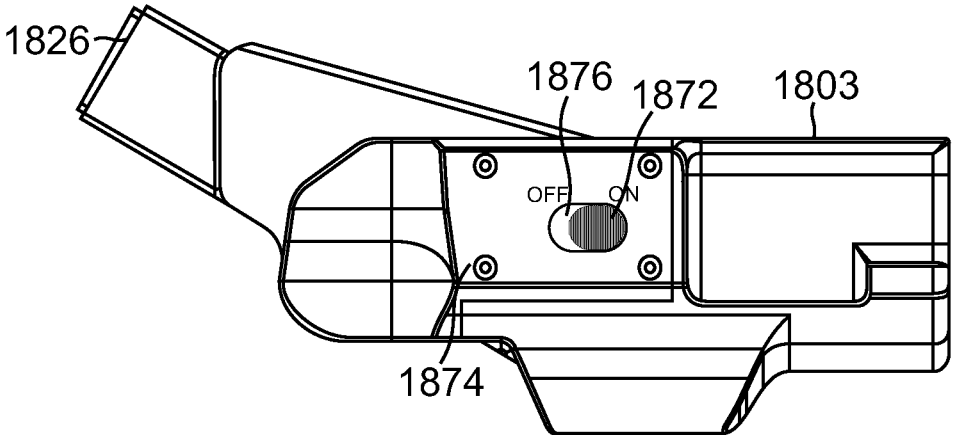
FIG. 37 is a right side elevation view of the third example holster.
Figure 38:
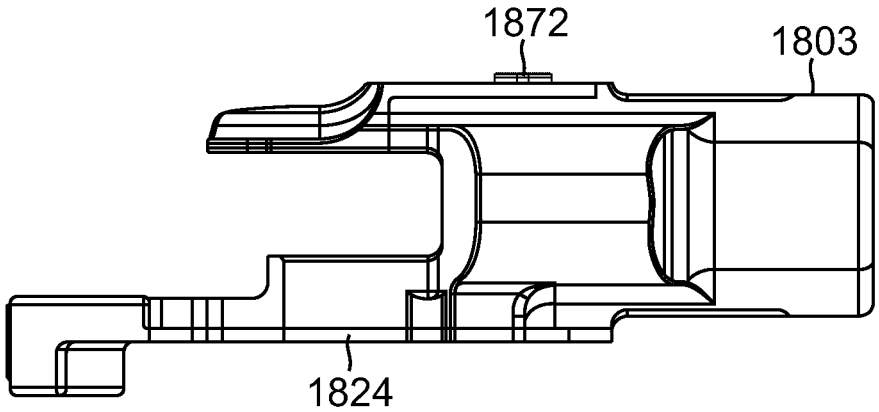
FIG. 38 is a bottom plan view of the third example holster.
Figure 39:
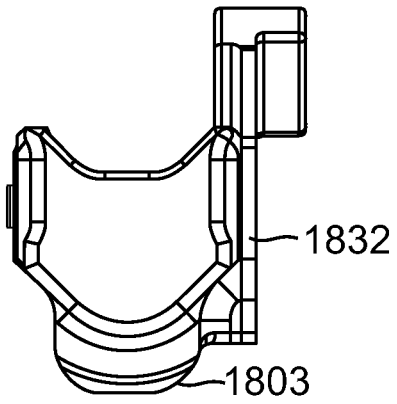
FIG. 39 is a front end elevation view of the third example holster.
Figure 40:
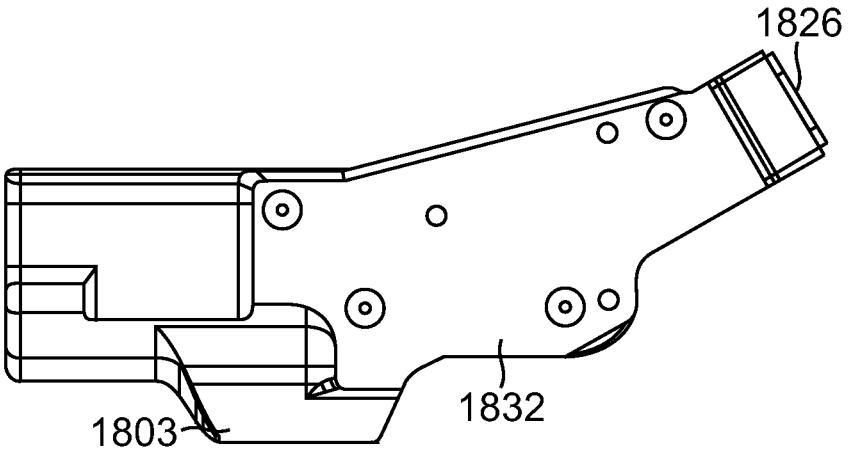
FIG. 40 is a left side elevation view of the third example holster.
Figure 41:
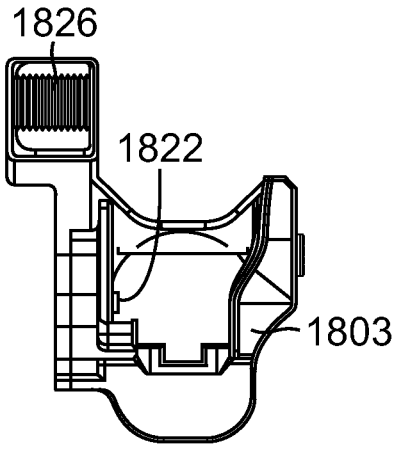
FIG. 41 is a rear end elevation view of the third example holster.

Thus, for example, as can be seen in FIGS. 28 and 31, the cylindrical bezel of the illuminator component 1808 of the light accessory 1804 includes a pair of rearwardly extending slots 1818 on opposite sides thereof. Each of the slots 1818 includes a chamfer 1820 on the upper edge thereof. Each of the slots 1818 is configured to receive a corresponding one of a pair of opposing cylindrical lands 1822 disposed on opposing side walls the U-shaped housing 1803, as illustrated in, e.g., FIG. 36, in a slide-in engagement. In particular, as the muzzle end of the gun 1802 is advanced distally into the holster 1800, the chamfer 1820 acts to guide of the lands 1822 into corresponding ones of the slots 1818, until the lands "bottom-out" at the back end of the slots 1818. At this point, the muzzle end of the gun 1802 is restrained from further distal movement, and the gun 1802 is then disposed on the lands 1822 for a pivotal movement toward the floor of the housing 1803 and a releasable latching mechanism in the housing 1803, as described below.

Figure 35:
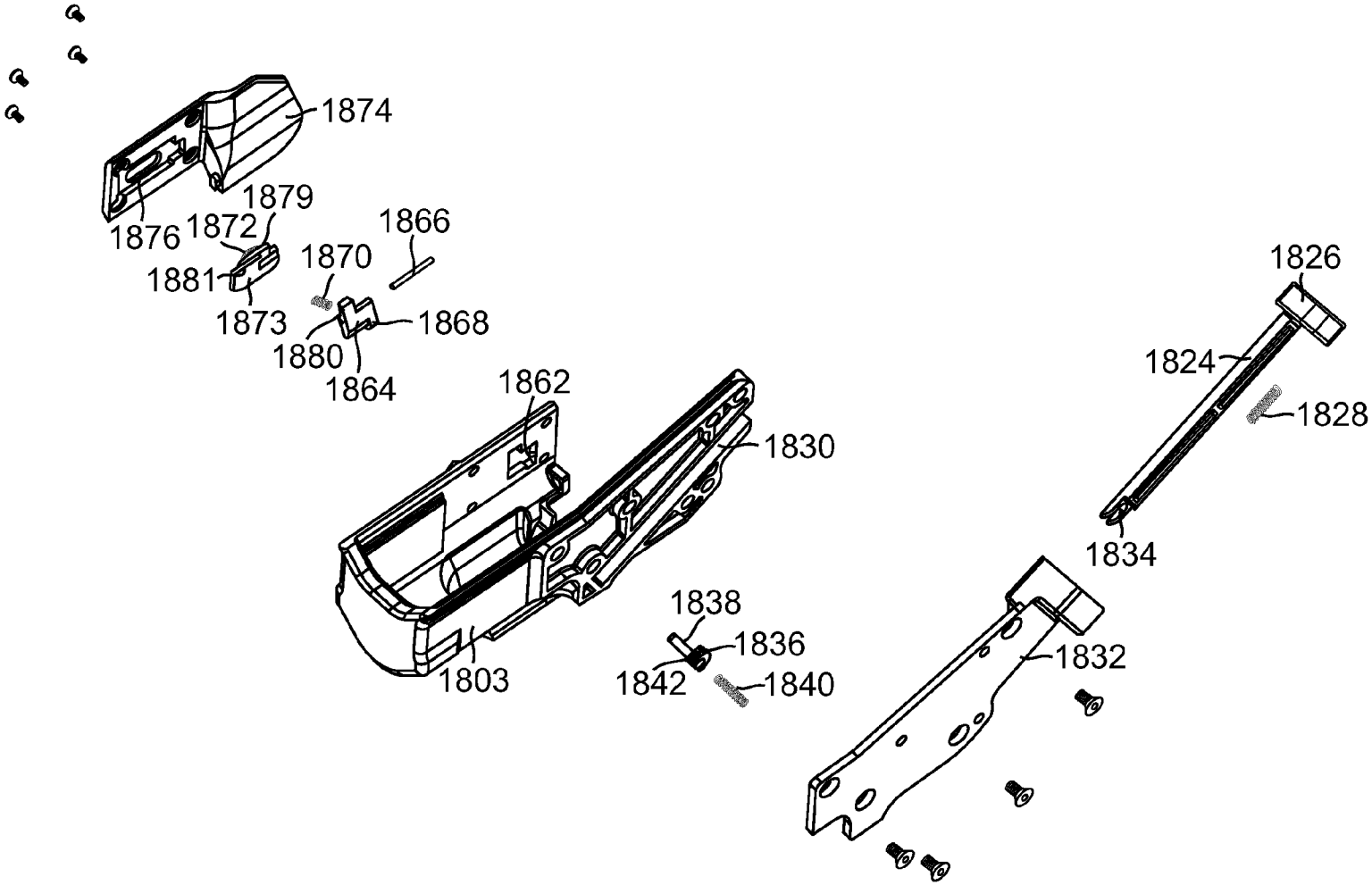
FIG. 35 is an upper, left side, front exploded perspective view of the third example holster.

As can be seen in, e.g., FIGS. 26 and 35, the third embodiment includes an elongated push rod 1824 that can be actuated by a push button 1826 returned by a spring 1828, as in the first embodiment above. As illustrated in FIG. 35, the push rod 1824 is slideably retained in a slot 1830 on the medial side of the housing 1803 for reciprocating movement therein by a medial plate 1832. The push rod 1824 includes a bifurcated distal end 1834 that includes a camming surface on each of the bifurcations thereof. As can be seen in, e.g., FIG. 35, the bifurcated end 1834 of the push rod 1824 is arranged to engage the head 1836 of a retaining pin 1838 that is normally biased through a corresponding opening in the medial sidewall of the housing 1803 and toward the center of the housing 1803 by a bias spring 1840, which along with the retaining pin 1838, is held in place by the medial side plate 1832. The head 1836 of the retaining pin 1838 includes camming surfaces 1842 that, when the push button 1826 is depressed by the user, are engaged by the complementary camming surfaces on the bifurcated end 1834 of the pushrod 1824 to withdraw the distal end of the pin 1838 from the center of the housing 1803.

Referring back to FIGS. 28 and 31, it can be seen that the rear end of the light accessory 1804 includes a pair of oval bores 1844, each of which tapers into a cylindrical bore 1846 at the inner ends thereof. A ramped surface 1848 underlies each of these double bores 1844, 1846. The bores 1844, 1846 are arranged such that, when the rear of the gun 1802 pivots downward toward the floor of the housing 1803 on the cylindrical lands 1822 at the front of the housing 1803, the distal end of the retaining pin 1838 (see FIG. 35) first engages, and is displaced away from the center of the housing 1803 by, the opposing ramp 1848 on the light accessory 1804. This permits the rear end of the gun 1802 to continue to pivot downward towards the floor of the housing 1803 until the distal end of the retaining pin 1838 engages the corresponding oval bore 1844. The bias of the bias spring 1840 then urges the distal end of the retaining pin 1838 into the oval bore 1844, which, in turn, guides it into engagement with the cylindrical bore 1846, thereby locking the light accessory 1804, and hence, the gun 1802, in the holster 1800.

The gun 1802 is securely retained in the holster 1800 by the lands 1822 and the retaining pin 1838 until it is released by the user's actuation of the push button 1826, as above. Thereafter, the gun 1802 can be withdrawn from the holster 1800 by quickly by rearward movement of the gun 1802 of less than about 0.25 in.

As discussed above, one of the several advantages of the example holster 1800 is that it is capable, at the user's option, of activating the light accessory 1804 when the gun 1802 is drawn from the holster 1800, and further, of deactivating it whenever the gun 1802 is inserted in the holster 1800, in the manner described below.

Figure 33:
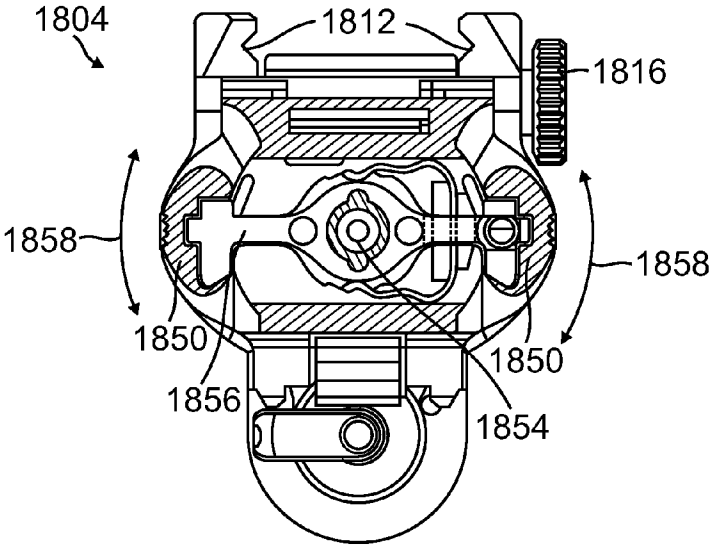
FIG. 33 is a cross-sectional view of a rocker switch of the lighting accessory, as seen along the lines of the section 33-33 taken in FIG. 31.

As can be seen in, e.g., FIGS. 27-29 and 32, the light accessory 1804 is provided with a pair of ribbed and scalloped finger actuator buttons 1850 (e.g., and/or other types of user controls) that are operable when actuated, to operate a rocker switch in the light accessory, and thereby actuate the light accessory. Of importance, each of the buttons 1850 includes a pair of scalloped surfaces 1852 that taper toward each other in a rearward direction. FIG. 33 is a cross-sectional view of the rocker switch 1854 of the light accessory 1804, as seen along the lines of the section 33-33 taken in FIG. 31. As can be seen in FIG. 33, the buttons 1850 are respectively coupled to ends of an arm 1856 for bi-directional rotation in the direction of the arrows 1858 such that rotation of either of the buttons 1850 in either an upward or downward direction causes the opposite button 1850 to rotate in the opposite direction, and more particularly, causes the rocker switch to activate the light accessory, i.e., turn it on. In this manner, the buttons 1850 can be used conveniently by either a right-handed or a left-handed user. Further, when the buttons 1850 and rocker arm 1856 are disposed in "middle," or horizontal position shown in FIG. 33, the rocker switch 1854 is in the off position, and hence, the lighting device 1804 is de-activated, or off.

Figure 42:
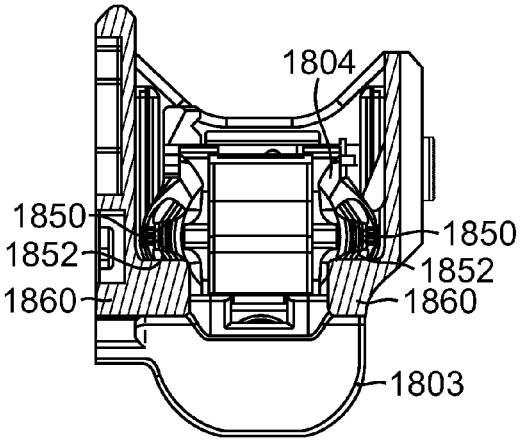
FIG. 42 is a partial cross-sectional view of the third example holster and associated light accessory, as seen along the lines of the section 42-42 taken in FIG. 21, showing a pair of upstanding tabs arranged to deactivate the light accessory when the associated hand gun is inserted in the holster.
Figure 43:
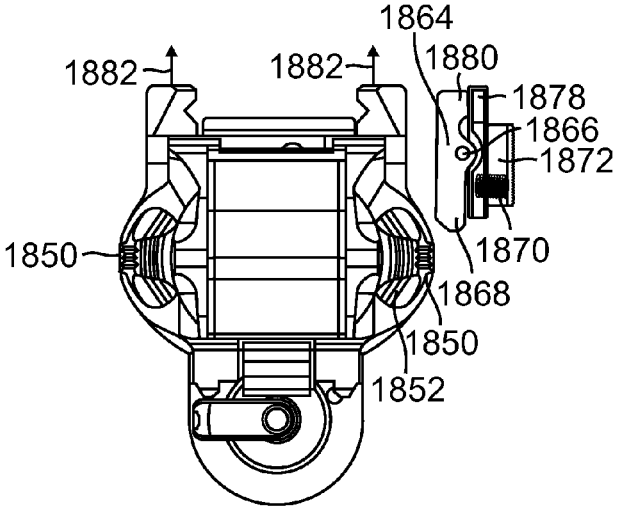
FIG. 43 is a partial cross-sectional view of the third example holster and associated light accessory, as seen along the lines of the section 43-43 taken in FIG. 21, showing a bi-positional lever arm and a user-selectable slide button that, at the user's option, can activate the light accessory when the gun is drawn from the holster, shown in a "do not activate" position.

This arrangement enables the holster 1800 to de-activate or turn off the light accessory 1804 whenever the gun 1802 and light accessory 1804 are inserted in the holster 1800. As illustrated in the top plan view of FIG. 32 and the cross-sectional view of FIG. 42, to this end, a pair of upstanding lands 1860 can be disposed on the floor of the housing 1803 below corresponding ones of the buttons 1850 and arranged such that, when the rear end of the gun 1802 pivots downward about the lands 1822 and toward the floor of the housing 1803 as described above, the upper ends of the lands 1860 will contact the scallops 1852 in corresponding ones of the buttons 1850 and, regardless of which, if either, is rotated to the on position, will urge both buttons 1850, and hence, the rocker switch 1854, to their off or horizontal position, and retain them at that position for as long as the gun 1802 and light accessory 1804 are retained in the holster 1800.

Additionally, as discussed above, the example holster is further capable, at the user's option, of activating the light accessory 1804 when the gun 1802 is drawn from the holster 1800. In regard to this aspect of the example holster 1800, reference is made to, e.g., FIGS. 26, 34, 35 and 43. As can be seen in these figures, the housing 1803 of the holster 1800 can be provided with an opening 1862 within which an actuator lever 1864 is disposed for pivotal movement by a pivot pin 1866. The lever 1864 has a lower portion 1868 that is biased to rotate inwardly relative to the distal wall of the housing 1803 by a bias spring 1870. A selector button 1872 (e.g., and/or other type of user selector/switch) is mounted on a plate 1873 that is slideably disposed between the outer surface of the distal wall of the housing 1803 and a distal plate 1874. The distal plate 1874 also serves to captivate the actuator lever 1864, pivot pin 1866 and the bias spring 1870 against the housing 1803. The distal plate 1874 includes a slotted aperture 1876 through which the selector button 1872 protrudes laterally. Of importance, the sliding plate 1873 of the selector button 1872 also includes a notch 1878 disposed in the upper rear corner thereof.

The actuator lever 1864 also includes an upper portion 1880 that is biased into abutment with the sliding plate 1873 of the selector button 1872 by the bias spring 1870. Thus, when the selector button is disposed in the "off" position indicated on the distal plate 1874 above the slotted aperture 1876 therein, the sliding plate 1873 prevents the upper portion 1880 of the actuator lever 1864 from rotating outward from the housing 1803, and hence, the lower portion 1866 of the lever from rotating inward, as illustrated in the partial cross-sectional elevation view of FIG. 43. As a result, when the rear end of the gun 1802 is pivoted upwardly about the lands 1822 at the front of the housing 1803, as indicated by the arrows 1882 in FIGS. 43 and 44, the scallops 1852 on the finger buttons 1850, which are disposed immediately below the lower end of the actuator lever 1864, will move past the actuator lever 1864 with a clearance, and the light accessory 1804 will remain in the off condition as the gun 1802 is removed from the holster 1800.

Figure 44:
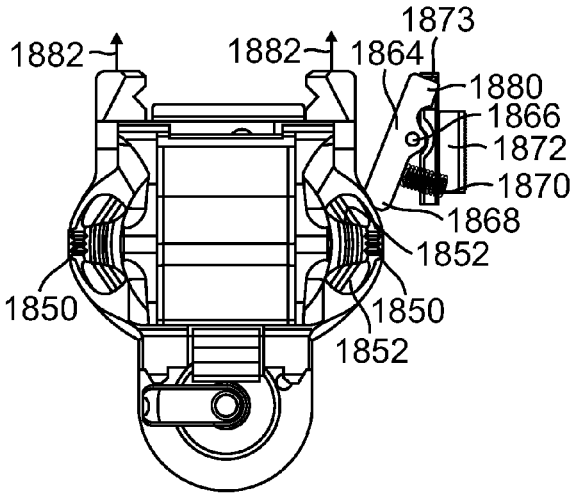
FIG. 44 is a partial cross-sectional view of the third example holster and associated light accessory, as seen along the lines of the section 44-44 taken in FIG. 21, showing the bi-positional lever arm and button in an "activate position."

However, if the user chooses to slide the selector button 1872 to the "on" position indicated on the distal plate 1874 above the slotted aperture 1876, this will cause the notch 1878 in the sliding plate 1873 to be disposed immediately opposite to the upper end 1880 of the actuator lever 1864. This selection enables the upper end 1880 of the actuator lever 1864 to pivot outwardly, and hence, the lower end 1866 thereof to pivot inwardly, as illustrated in FIG. 44. Then, when the gun 1802 is pivoted out of the holster 1800 in the direction of the arrows 1882, the scallop 1852 of the finger button 1850 disposed below the actuator lever 1864 will engage the lower end of the lever 1864 as the gun 1802 leaves the holster 1800, causing the finger button 1850 to rotate downward, and thereby activate, or turn on, the light accessory 1804.

The user may selectively slide the selector button 1872 back from the "on" position to the "off" position while the gun 1802 remains in the holster 1800, or alternatively while the gun 1802 is drawn. In either case, a surface of notch 1878 may push against an appropriately chamfered surface of the upper potion 1880 of the actuator lever 1864 to rotate actuator lever 1864 inward back toward the housing 1803 and thus also rotate the lower portion 1866 of the actuator lever 1864 outward toward the housing 1803.

Figure 34:
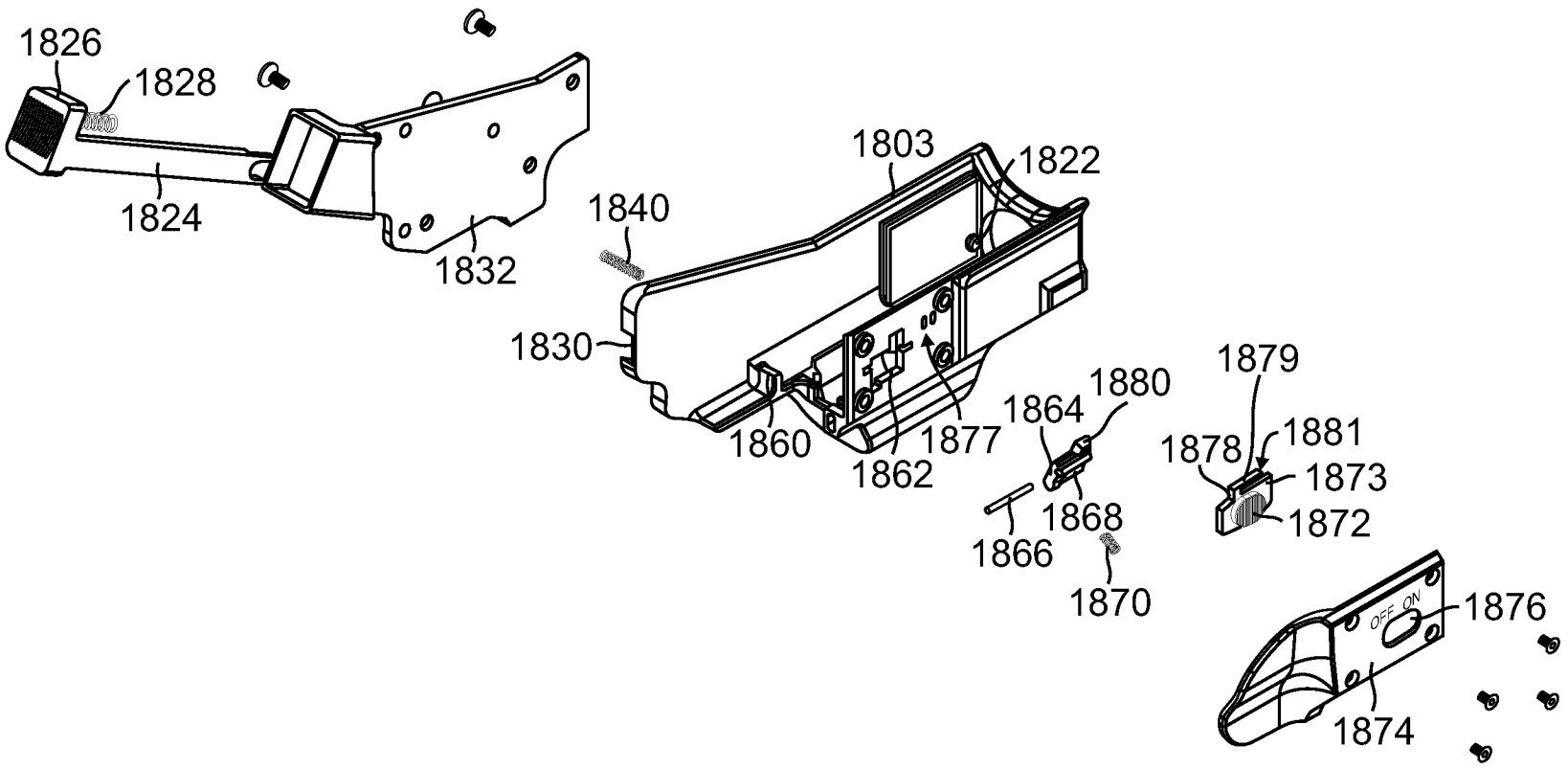
FIG. 34 is an upper, right side, rear exploded perspective view of the third example quick draw holster, wherein the associated handgun and light accessory have been omitted for purposes of illustration.

As shown in FIG. 34, an arm 1879 extending from plate 1873 may include an engagement surface 1881 (e.g., a cam or other structure as appropriate) facing housing 1803 and configured to engage with corresponding recesses 1877 in housing 1803 to maintain selector button 1872 and plate 1873 in "on" or "off" positions as selected by the user.

It may be further noted that, if the selector button 1872 is left in the "on" position, when the gun 1802 is replaced in the holster 1800, the lower scallop 1852 of the finger button 1850 will rotate the lower portion 1866 of the actuator lever 1864 outwardly to permit the button 1850 to return to a position below the lever 1864. However, after the button 1850 is disposed below the lever 1864, the lower portion 1866 of the lever 1864 will again pivot inwardly to the position shown in FIG. 44 such that, the next time the gun 1802 is removed from the holster 1800, the light accessory 1804 will again be activated as described above. Of course, as also described above, the light accessory 1802 will always be deactivated whenever the gun 1802 is disposed in the holster 1800.

The foregoing description is presented so as to enable any person skilled in the art to make and use the invention. For purposes of explication, specific nomenclature has been set forth to provide a thorough understanding of the disclosure. However, it should be understood that the descriptions of specific embodiments or applications provided herein are provided only by way of some example embodiments of the invention, and not by way of any limitations thereof. Indeed, various modifications to the embodiments will be readily apparent to those skilled in the art, and the general principles defined herein can be applied to other embodiments and applications without departing from the spirit and scope of the invention. Thus, the present invention should not be limited to the particular embodiments illustrated and described herein, but rather, should be accorded the widest possible scope consistent with the principles and features disclosed herein.

What is claimed is:

1. A holster comprising:

a housing adapted to receive a handgun assembly comprising a handgun and an accessory device attached to the handgun;

a structure protruding from the housing and adapted to:

move a switch of the accessory device to an off position as the handgun assembly is inserted into the holster, and hold the switch in the off position while the handgun assembly is retained in the holster;

wherein the structure comprises first and second lands adapted to engage corresponding first and second user controls of the accessory device as the handgun assembly is inserted into the holster; and wherein an engagement of at least one of the lands with at least one of the user controls causes the switch to move to the off position.

2. The holster of claim 1, wherein the accessory device is a lighting device.

3. A holster comprising:

a housing adapted to receive a handgun assembly comprising a handgun and an accessory device attached to the handgun;

a structure protruding from the housing and adapted to:

move a switch of the accessory device to an off position as the handgun assembly is inserted into the holster, and hold the switch in the off position while the handgun assembly is retained in the holster;

an actuator adapted to selectively move the switch to an on position as the handgun assembly is withdrawn from the holster;

wherein the actuator is adapted to move between a neutral position and an engaged position;

wherein the actuator in the neutral position is adapted to not move the switch as the handgun assembly is withdrawn from the holster; and wherein the actuator in the engaged position is adapted to move the switch from the off position to the on position as the handgun assembly is withdrawn from the holster.

4. The holster of claim 3, further comprising a user selector adapted to control the position of the actuator to determine whether the accessory device turns on or remains off as the handgun assembly is withdrawn from the holster.

5. The holster of claim 4, wherein:

the actuator is biased to pivot from the neutral position to the engaged position;

the user selector is adapted to slide relative to the housing between first and second positions;

the user selector in the first position prevents the actuator from pivoting from the neutral position to the engaged position; and the user selector in the second position permits the actuator to pivot from the neutral position to the engaged position.

6. A holster comprising:

a housing adapted to receive a handgun assembly comprising a handgun and an accessory device attached to the handgun, wherein the housing comprises first and second side walls defining an internal cavity;

a structure protruding from the housing and adapted to:

move a switch of the accessory device to an off position as the handgun assembly is inserted into the holster, and hold the switch in the off position while the handgun assembly is retained in the holster;

first and second guide pins on the first and side walls, respectively, wherein each guide pin is adapted to be received by a corresponding slot of the handgun assembly; and a locking pin adapted to engage a latching feature of the handgun assembly as the handgun assembly rotates in a first direction about an axis corresponding to an engagement of the guide pins and the slots.

7. The holster of claim 6, wherein the holster further comprises:

a user push button; and an unlocking mechanism adapted to disengage the locking pin from the latching feature in response to actuation of the user push button.

8. The holster of claim 7, wherein the holster is adapted to permit the handgun assembly to be withdrawn from the holster after:

the locking pin is withdrawn from the latching feature;

the handgun assembly is rotated in a second direction opposite to the first direction; and the guide pins disengage from the slots.

9. The holster of claim 3, wherein the holster further comprises a pawl adapted to selectively engage with a ratchet of the handgun assembly to permit the handgun assembly to slide into the holster and to prevent the handgun assembly from being withdrawn from the holster until the pawl is released from the ratchet.

10. The holster of claim 9, wherein the ratchet comprises a land projecting from the handgun assembly and adapted to be slid into a groove in a side wall of the housing.

11. The holster of claim 9, wherein the holster further comprises:

a user push button; and an unlocking mechanism adapted to disengage the pawl from the ratchet in response to actuation of the user push button.

12. A holster comprising:

a housing adapted to receive a handgun assembly comprising a handgun and an accessory device attached to the handgun;

a structure protruding from the housing and adapted to:

move a switch of the accessory device to an off position as the handgun assembly is inserted into the holster, and hold the switch in the off position while the handgun assembly is retained in the holster;

a cam;

wherein the housing comprises a sidewall comprising a longitudinal groove and a slot extending between a lower edge of the side wall and the groove;

wherein the groove is adapted to receive a land of the handgun assembly;

wherein the land is adapted to slide forwardly a first distance in the groove as the handgun assembly is inserted into the holster, and rearwardly a second distance in the groove to engage the cam as the handgun assembly is withdrawn from the holster;

wherein the cam is adapted to eject the land through the slot of the side wall and in a direction generally perpendicular to the groove in response to the engagement of the land and the cam; and wherein the second distance is shorter than the first distance.

13. The holster of claim 12, wherein the cam is adapted to pivot out of the groove and back into the groove as the land slides forwardly in the groove.

14. A method comprising:

inserting a handgun assembly into a housing of a holster, wherein the handgun assembly comprises a handgun and an accessory device attached to the handgun;

moving a switch of the accessory device to an off position in response to the inserting, wherein the moving is performed by a structure protruding from the housing;

holding the switch in the off position while the handgun assembly is retained in the holster, wherein the holding is performed by the structures;

wherein the structure comprises first and second lands adapted to engage corresponding first and second user controls of the accessory device; and wherein the moving comprises engaging at least one of the lands with at least one of the user controls to move the switch to the off position.

15. The method of claim 14, wherein the accessory device is a lighting device.

16. A method comprising:

inserting a handgun assembly into a housing of a holster, wherein the handgun assembly comprises a handgun and an accessory device attached to the handgun;

moving a switch of the accessory device to an off position in response to the inserting, wherein the moving is performed by a structure protruding from the housing;

holding the switch in the off position while the handgun assembly is retained in the holster, wherein the holding is performed by the structure;

withdrawing the handgun assembly from the holster;

selectively moving the switch to an on position during the withdrawing, wherein the selectively moving is performed by an actuator of the holster;

moving the actuator between a neutral position and an engaged position; and wherein the selectively moving comprises:

if the actuator is in the neutral position, not moving the switch during the withdrawing, and if the actuator in the engaged position, moving the switch from the off position to the on position during the withdrawing.

17. The method of claim 16, further comprising operating a user selector to control the position of the actuator to determine whether the accessory device turns on or remains off as the handgun assembly is withdrawn from the holster.

18. The method of claim 17, wherein:

the actuator is biased to pivot from the neutral position to the engaged position;

the operating comprises sliding the user selector relative to the housing between first and second positions;

while the user selector is in the first position, preventing the actuator from pivoting from the neutral position to the engaged position; and while the user selector is in the second position, permitting the actuator to pivot from the neutral position to the engaged position.

19. A method comprising:

inserting a handgun assembly into a housing of a holster, wherein the handgun assembly comprises a handgun and an accessory device attached to the handgun;

moving a switch of the accessory device to an off position in response to the Inserting wherein the moving is performed b a structure protruding from the housing holding the switch in the off position while the handgun assembly is retained in the holster, wherein the holding is performed by the structure;

receiving first and second guide pins in corresponding slots of the handgun assembly, wherein the first and second guide pins are on first and second side walls, respectively, of the housing;

rotating the handgun assembly in a first direction about an axis corresponding to an engagement of the guide pins and the slots; and engaging a locking pin of the holster with a latching feature of the handgun assembly in response to the rotating.

20. The method of claim 19, further comprising:

actuating a user push button; and disengaging the locking pin from the latching feature in response to the actuating.

21. The method of claim 20, further comprising:

after the disengaging, rotating the handgun assembly in a second direction opposite to the first direction;

removing the guide pins from the slots; and thereafter withdrawing the handgun assembly from the holster.

22. The method of claim 16, further comprising selectively engaging a pawl of the holster with a ratchet of the handgun assembly to permit the handgun assembly to slide into the holster during the inserting and to prevent the handgun assembly from being withdrawn from the holster until the pawl is released from the ratchet.

23. The method of claim 22, wherein the ratchet comprises a land projecting from the handgun assembly and adapted to slide into a groove in a side wall of the housing.

24. The method of claim 22, further comprising:

actuating a user push button; and disengaging the pawl from the ratchet in response to the actuating.

25. A method comprising:

inserting a handgun assembly into a housing of a holster, wherein the handgun assembly comprises a handgun and an accessory device attached to the handgun;

moving a switch of the accessory device to an off position in response to the inserting, wherein the moving is performed by a structure protruding from the housing;

holding the switch in the off position while the handgun assembly is retained in the holster, wherein the holding is performed by the structure;

wherein the housing comprises a sidewall comprising a longitudinal groove and a slot extending between a lower edge of the side wall and the groove;

wherein the inserting comprises: receiving a land of the handgun assembly in the groove, and sliding the land forwardly a first distance in the groove;

sliding the land rearwardly a second distance in the groove to engage a cam of the holster;

ejecting the land through the slot of the side wall and in a direction generally perpendicular to the groove in response to the engagement of the land and the cam; and wherein the second distance is shorter than the first distance.

26. The method of claim 25, further comprising pivoting the cam out of the groove and back into the groove as the land slides forwardly in the groove.

* * * * *

UNITED STATES PATENT AND TRADEMARK OFFICE

CERTIFICATE OF CORRECTION

PATENT NO. : 9,057,580 B2
APPLICATION NO. : 13/890570
DATED : June 16, 2015
INVENTOR(S) : Steven Rorick et al.

It is certified that error appears in the above-identified patent and that said Letters Patent is hereby corrected as shown below:

In the Claims

In column 18, line 18, change “the first and side walls” to --the first and second side walls--.

Signed and Sealed this
Twenty-ninth Day of September, 2015

Michelle K. Lee

Michelle K. Lee
*Director of the United States Patent and Trademark Office*